US010626600B2

(12) United States Patent
Feldpausch et al.

(10) Patent No.: US 10,626,600 B2
(45) Date of Patent: Apr. 21, 2020

(54) PARTITION ASSEMBLY

(71) Applicant: Steelcase Inc., Grand Rapids, MI (US)

(72) Inventors: Michael J. Feldpausch, Middleville, MI (US); Marvin C. Knauf, Conklin, MI (US); Bradley D. Youngs, Byron Center, MI (US); Mark T. Slager, Caledonia, MI (US); Kurt R. Heidmann, Grand Rapids, MI (US); John R. Hamilton, San Rafael, CA (US); Ryan Geister, Alto, MI (US); Daniel Phillips, Kentwood, MI (US)

(73) Assignee: Steelcase Inc., Grand Rapids, MI (US)

( * ) Notice: Subject to any disclaimer, the term of this patent is extended or adjusted under 35 U.S.C. 154(b) by 116 days.

(21) Appl. No.: 15/804,642

(22) Filed: Nov. 6, 2017

(65) Prior Publication Data

US 2018/0073249 A1 Mar. 15, 2018

Related U.S. Application Data

(63) Continuation of application No. 14/543,214, filed on Nov. 17, 2014, now abandoned, which is a (Continued)

(51) Int. Cl.
*E04B 2/74* (2006.01)
*E04C 2/52* (2006.01)

(52) U.S. Cl.
CPC ..... *E04B 2/7422* (2013.01); *E04C 2/52* (2013.01); *E04B 2002/749* (2013.01); (Continued)

(58) Field of Classification Search
CPC . E04B 2/52; E04B 2/74; E04B 2/7407; E04B 2/7416; E04B 2/7422; (Continued)

(56) References Cited

U.S. PATENT DOCUMENTS 3,749,432 A 7/1973 Janssen
3,778,175 A 12/1973 Zimmer
(Continued)

FOREIGN PATENT DOCUMENTS

KR 20-0370195 12/2004
WO WO 2006003005 1/2006

*Primary Examiner* — Jessica L Laux
(74) *Attorney, Agent, or Firm* — Price Heneveld LLP

(57) ABSTRACT

A partition assembly for subdividing a floor plan area that includes a beam assembly including a beam member including an upper wall, a pair of side walls, a bottom wall, first and second ends, and a pair of channels extending between the first and second ends, each of the channels positioned closer to one of the pair of side walls than to a longitudinally-extending center line of the beam member, a lower frame member located below the beam member, and vertical frame members extending between the beam member and the lower frame member, a work tool positioned above the beam assembly, and a connector assembly connecting the work tool to the beam assembly, where the connector assembly is coupled to the work tool and engages the pair of channels of the beam member.

27 Claims, 28 Drawing Sheets

Related U.S. Application Data continuation of application No. 12/472,859, filed on May 27, 2009, now Pat. No. 8,910,435, and a continuation of application No. 12/472,848, filed on May 27, 2009, now Pat. No. 9,611,641.

(60) Provisional application No. 61/056,349, filed on May 27, 2008, provisional application No. 61/056,323, filed on May 27, 2008.

(52) U.S. Cl.
CPC ..... *E04B 2002/7462* (2013.01); *E04B 2002/7466* (2013.01); *E04B 2002/7483* (2013.01)

(58) Field of Classification Search
CPC ..... E04B 2/7425; E04B 2/7488; E04B 2002/4118; E04B 2002/742; E04B 2002/7487; E04B 2002/7462; E04B 2002/7466; E04B 2002/7483; E04B 2002/749; E04C 2/52
See application file for complete search history.

(56) References Cited

U.S. PATENT DOCUMENTS 4,203,639 A 5/1980 Vanden Hoeck et al.
4,224,769 A 9/1980 Ball et al.
4,270,020 A 5/1981 Kenworthy et al.
4,277,123 A 7/1981 Haworth et al.
4,278,834 A 7/1981 Boundy
4,308,418 A 12/1981 Van Kulk et al.
4,367,370 A 1/1983 Wilson et al.
4,382,642 A 5/1983 Burdick
4,596,098 A 6/1986 Finkbeiner et al.
4,619,486 A 10/1986 Hannah et al.
4,634,212 A 1/1987 Boundy et al.
4,713,918 A 12/1987 Cioffi
4,720,953 A 1/1988 Onishi et al.
4,771,583 A 9/1988 Ball et al.
4,800,695 A 1/1989 Menchetti
4,831,791 A 5/1989 Ball
4,845,904 A 7/1989 Menchetti
4,914,873 A 4/1990 Newhouse
4,918,886 A 4/1990 Benoit et al.
4,942,713 A 7/1990 Jackson
4,974,913 A 12/1990 Vogt et al.
5,058,331 A 10/1991 Epps
5,062,246 A 11/1991 Sykes
5,081,809 A 1/1992 Thompson
5,155,955 A 10/1992 Ball et al.
5,186,425 A 2/1993 Keusch et al.
5,203,713 A 4/1993 French et al.
5,244,401 A 9/1993 Russell et al.
5,274,970 A 1/1994 Roberts
5,277,609 A 1/1994 Ondrejka
5,318,454 A 6/1994 Deer et al.
5,349,135 A 9/1994 Mollenkopf et al.
5,362,923 A 11/1994 Newhouse et al.
5,381,994 A 1/1995 Welch
5,394,658 A 3/1995 Schreiner et al.
5,428,928 A 7/1995 Hellwig et al.
5,606,919 A 3/1997 Fox et al.
5,607,317 A 3/1997 King et al.
5,740,650 A * 4/1998 Seiber ..... A47B 57/425 403/297
5,746,035 A 5/1998 Seiber et al.
5,806,258 A 9/1998 Miedema et al.
5,852,904 A 12/1998 Yu
5,901,512 A 5/1999 Bullwinkle
5,970,662 A 10/1999 Corcorran et al.
6,009,675 A 1/2000 Waalkes et al.
6,076,308 A 6/2000 Lyon et al.
6,098,358 A 8/2000 Waalkes et al.
6,152,048 A 11/2000 Vander Park
6,161,347 A 12/2000 Yu et al.
6,176,561 B1 1/2001 Roels et al.
6,202,381 B1 3/2001 Dame et al.
6,218,612 B1 4/2001 McKitrick et al.
6,253,509 B1 7/2001 Hellwig et al.
6,295,775 B2 10/2001 Osterman et al.
6,301,846 B1 10/2001 Waalkes et al.
6,311,411 B1 11/2001 Beavers et al.
6,330,773 B1 12/2001 MacDonald et al.
6,349,516 B1 2/2002 Powell et al.
6,351,917 B1 3/2002 MacDonald et al.
6,357,199 B2 3/2002 Laukhuf et al.
6,367,213 B1 4/2002 Reuter et al.
6,408,579 B1 6/2002 Anderson et al.
6,420,727 B1 7/2002 Kano
6,481,168 B1 11/2002 Hodges et al.
6,490,829 B1 12/2002 Schreiner et al.
6,575,777 B2 6/2003 Henriott et al.
D477,153 S 7/2003 Thorp et al.
6,651,396 B2 11/2003 DeRuiter et al.
6,658,805 B1 12/2003 Yu et al.
6,725,784 B2 4/2004 Crinlon
6,745,998 B2 6/2004 Diffrient et al.
6,751,914 B2 6/2004 Zeh et al.
6,761,004 B2 7/2004 Anglin et al.
6,807,776 B2 * 10/2004 Girdwood ..... A47B 83/001 160/130
6,851,226 B2 2/2005 MacGregor et al.
6,857,712 B1 2/2005 Haberman
6,865,853 B2 3/2005 Burken et al.
6,910,306 B2 6/2005 Waalkes et al.
6,910,903 B2 6/2005 Kondas
6,920,727 B2 7/2005 Yu et al.
6,951,085 B2 10/2005 Hodges et al.
6,986,556 B2 1/2006 Haberman
7,108,141 B2 9/2006 Gonzalez-Rivera
7,125,088 B2 10/2006 Haberman
7,143,552 B2 12/2006 Vander Park
7,193,159 B2 3/2007 Makwinski et al.
7,249,624 B2 7/2007 Zeh et al.
2001/0013209 A1 * 8/2001 Waalkes ..... A47B 21/06 52/239
2001/0017009 A1 * 8/2001 Lininger ..... A47B 83/001 52/36.5
2002/0069601 A1 * 6/2002 Hodges ..... E04B 2/7425 52/481.2
2003/0005654 A1 1/2003 Weber et al.
2003/0051415 A1 * 3/2003 Remelts ..... A47B 21/00 52/36.1
2004/0093805 A1 * 5/2004 Underwood ..... A47B 46/005 52/36.1
2005/0039644 A1 * 2/2005 Sheahan ..... A47B 57/50 108/152
2007/0029904 A1 2/2007 Haberman
2008/0035031 A1 2/2008 Yamanishi
2008/0035034 A1 2/2008 Morita
2010/0175332 A1 * 7/2010 Henriott ..... A47B 96/067 52/36.6
2011/0289859 A1 * 12/2011 Picchio ..... A47B 83/001 52/36.4

* cited by examiner

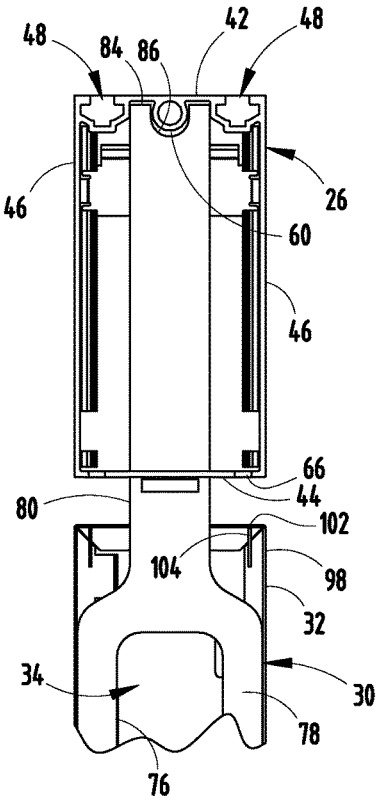
FIG. 10
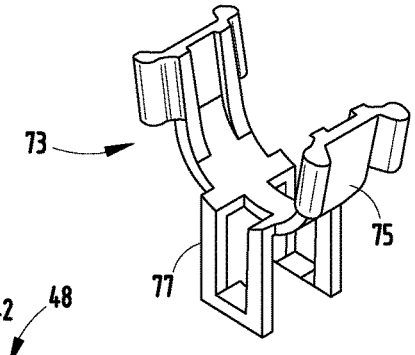
FIG. 10A
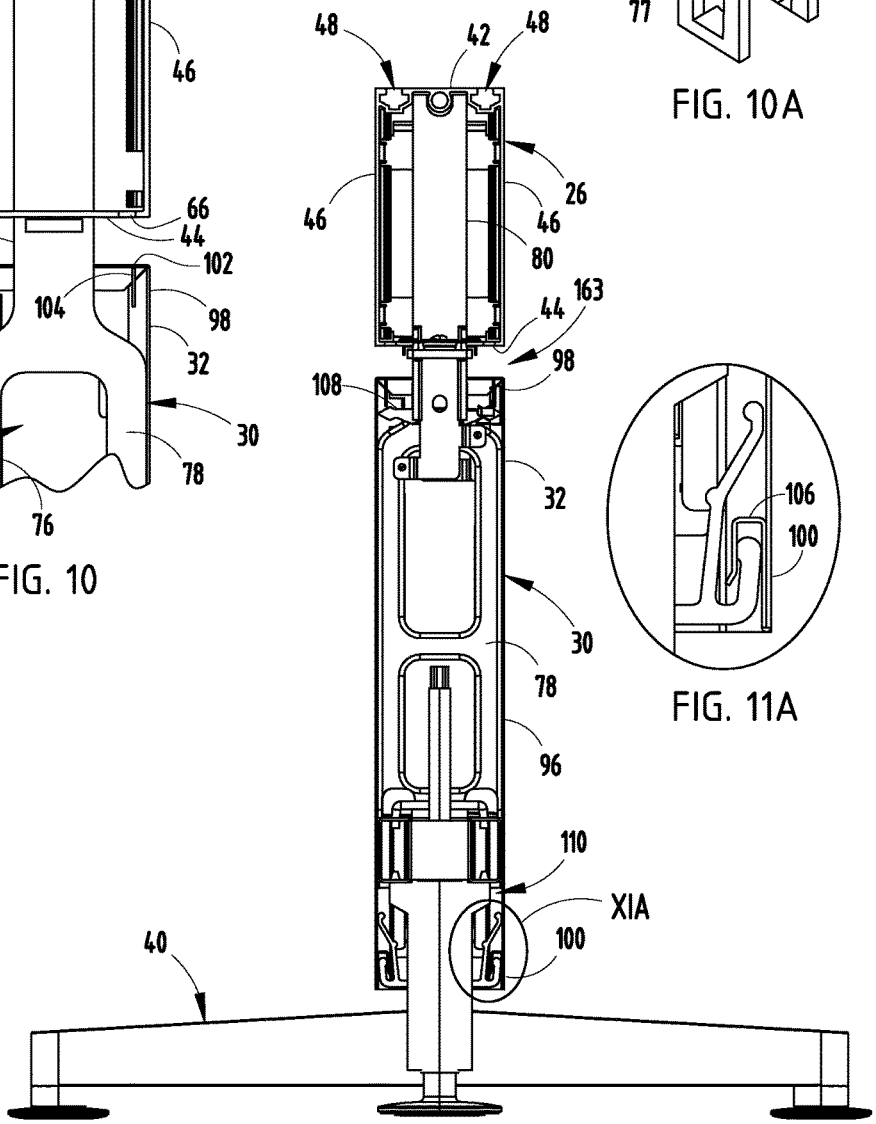
FIG. 11A
FIG. 11

PARTITION ASSEMBLY

CROSS REFERENCE TO RELATED APPLICATION

This application is a continuation of U.S. patent application Ser. No. 14/543,214, filed Nov. 17, 2014, entitled PARTITION ASSEMBLY, which is a continuation of U.S. patent application Ser. No. 12/472,859, filed May 27, 2009, entitled PARTITION ASSEMBLY, now U.S. Pat. No. 8,910,435, which claims benefit of U.S. Provisional Patent Application No. 61/056,323, filed May 27, 2008, entitled PARTITION ASSEMBLY, and a continuation of U.S. patent application Ser. No. 12/472,848, filed May 27, 2009, entitled BEAM ASSEMBLY, which claims benefit of U.S. Provisional Patent Application No. 61/056,349, filed May 27, 2008, entitled BEAM ASSEMBLY, which is hereby incorporated herein by reference in its entirety.

BACKGROUND OF THE INVENTION

The present invention relates to a partition assembly and in particular to a highly reconfigurable partition assembly allowing optimization of a floor plan area and individual workstations within that floor plan.

SUMMARY OF THE INVENTION

One aspect of the present invention is to provide a partition assembly for subdividing a floor plan area that includes a beam assembly that includes a horizontally extending beam member including an upper wall, a pair of side walls extending downwardly from the upper wall, a bottom wall extending between the pair of sidewalls, a first end, a second end, and a pair of upwardly opening channels located in the upper wall and extending between the first end and the second end, wherein each of the channels of the pair of channels is positioned closer to one of the pair of side walls than to a longitudinally-extending center line of the beam member, at least one horizontally extending lower frame member located below the beam member, and a plurality of vertical frame members extending between the beam member and the at least one lower frame member. The partition assembly also includes a work tool positioned above the beam assembly, and a connector assembly connecting the work tool to the beam assembly, where the connector assembly is coupled to the work tool and engages the pair of channels of the beam member.

Another aspect of the present invention is to include a beam assembly for subdividing a floor plan area that includes a horizontally extending beam member that includes an upper wall defining an uppermost edge of the beam assembly, a pair of side walls extending downwardly from the upper wall, a bottom wall extending between the pair of sidewalls, a first end, a second end, and a pair of upwardly opening channels located in the upper wall and extending between the first end and the second end, wherein the channels are configured to support a work tool above the beam member. The beam assembly also includes a pair of horizontally extending lower frame members located below the beam member, and a plurality of vertical frame members extending between the beam member and the pair of lower frame members, and positioned between the pair of lower frame members, wherein at least one of the plurality of vertical frame members includes a first width and a second width that is less that the first width, and wherein the second width is positioned directly between the pair of lower frame members.

Yet another aspect of the present invention is to include a beam assembly for subdividing a floor plan area that includes a horizontally extending beam member that includes an upper wall defining an uppermost edge of the beam assembly, a pair of side walls extending downwardly from the upper wall, a bottom wall extending between the pair of sidewalls, a first end, a second end, and a pair of upwardly opening channels located in upper wall and extending between the first end and the second end, wherein the pair of channels are configured to support a work tool therefrom. The beam assembly also includes at least one horizontally extending lower frame member located below the beam member, and a plurality of vertical frame members extending between the beam member and the at least one lower frame member, wherein at least one of the of the vertical frame members abuts a downwardly-facing surface of the beam member.

These and other advantages of the invention will be further understood and appreciated by those skilled in the art by reference to the following written specification, claims and appended drawings.

BRIEF DESCRIPTION OF THE DRAWINGS

FIG. 10 is an enlarged, partial end view of the beam assembly;

FIG. 10A is a perspective view of a grommet;

FIG. 11 is an end view of the beam assembly;

FIG. 11A is an enlarged view of area XIA, FIG. 11;

DETAILED DESCRIPTION OF THE PREFERRED EMBODIMENTS

Figure 4:
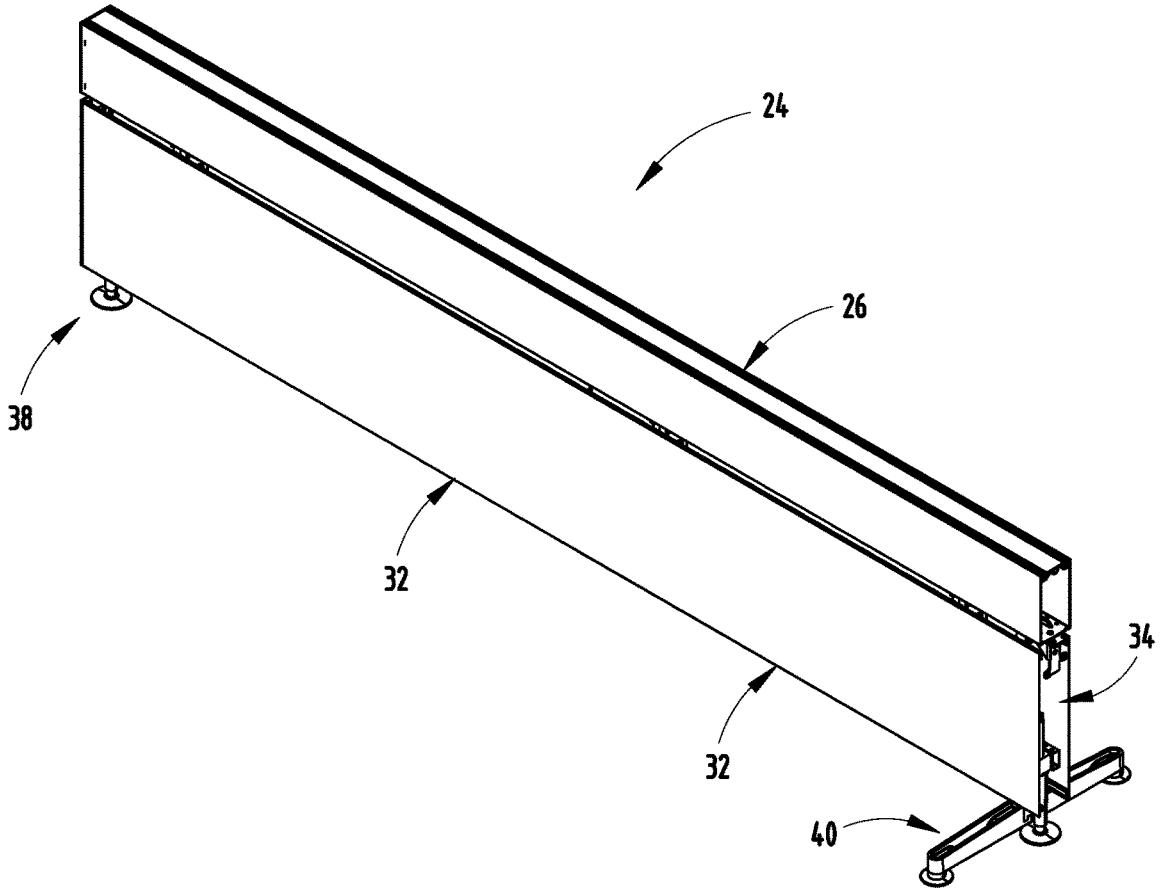
FIG. 4 is a perspective view of a beam assembly of the partition system.

For purposes of description herein, the terms "upper," "lower," "right," "left," "rear," "front," "vertical," "horizontal," and derivatives thereof shall relate to the invention as oriented in FIG. 4. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
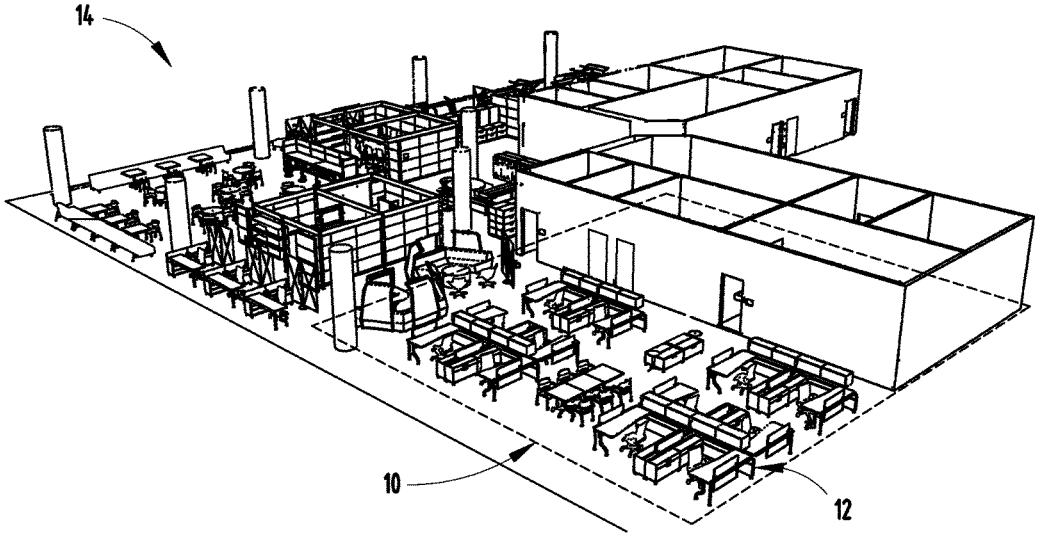
FIG. 1 is a perspective view of a floor plan area subdivided by a partition system embodying the present invention.
Figure 2:
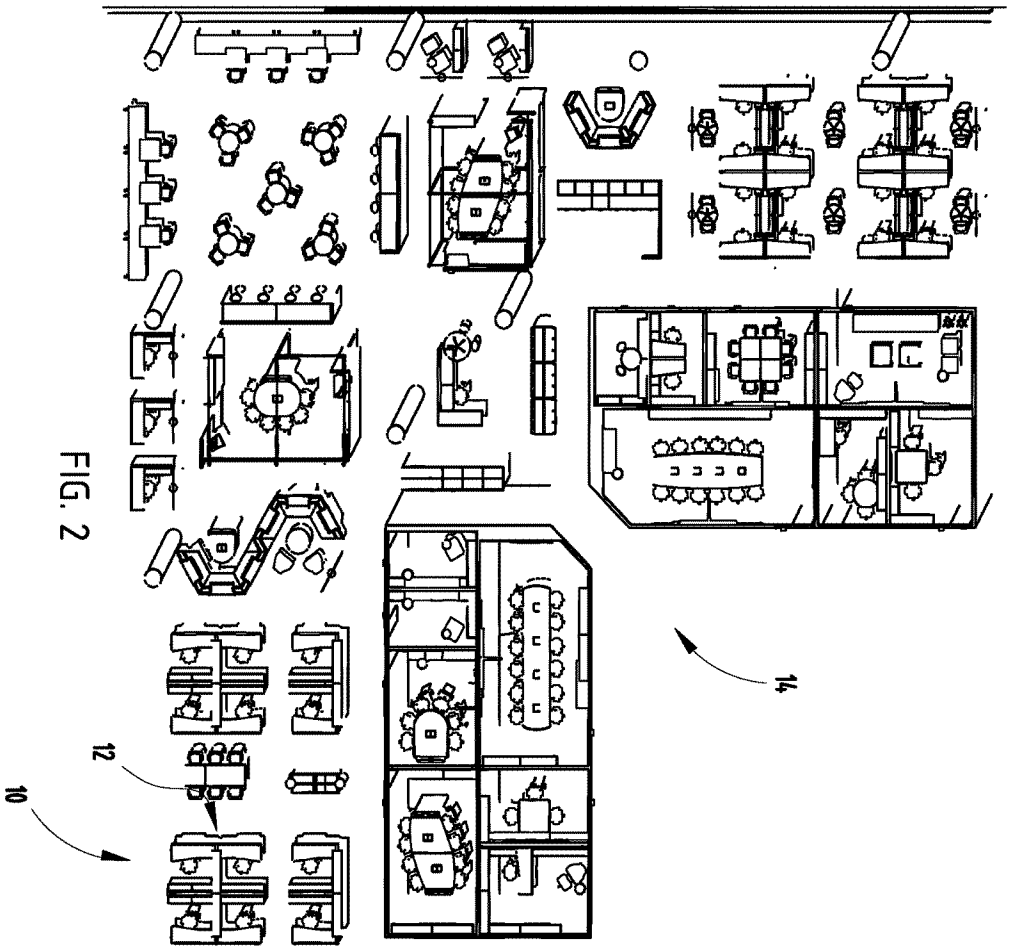
FIG. 2 is a top plan view of the floor plan area subdivided by the partition system.
Figure 3:
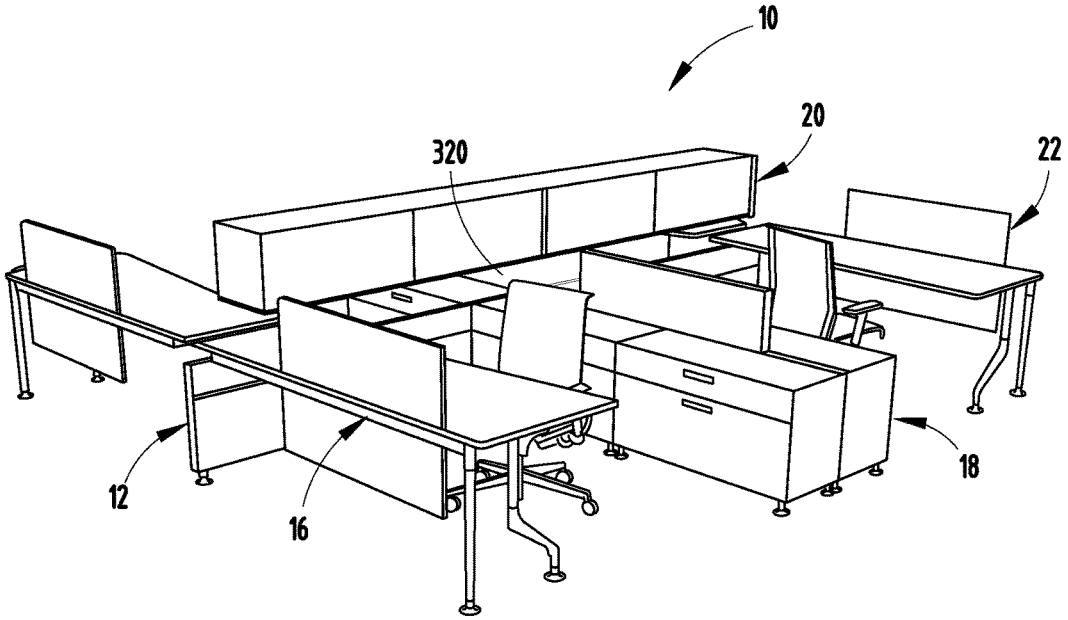
FIG. 3 is a perspective view of the partition system and a plurality of work tools supported therefrom.

Reference number 10 generally designates a furniture system (FIGS. 1 and 2) utilizing a partition assembly 12 embodying the present invention. The furniture system 10, and more particularly the partition assembly 12, is utilized to subdivide a given floor plan area 14 in an office environment either coupled with one another or as individual, stand-alone units. As best illustrated in FIG. 3, the furniture system 10 comprises the partition assembly 12 and a plurality of work tools that are supported by and/or extend outwardly from the partition assembly 12. In the illustrated example, the work tools include tables 16, lower storage units 18, elevated storage units 20, privacy screens 22, and the like. It is noted that while the illustrated example includes work tools that are coupled to and/or supported by the partition assembly 12, freestanding or stand-alone work tools may also be incorporated within the furniture system 10 as described herein. It is further noted that the furniture system 10 is constructed and configured such that the lower storage units 18 are positioned with respect to the partition assemblies 12, and below a normal line of sight of a seated user, and are preferably positioned such that a top surface of such work tools is located even with or below an uppermost surface of each partition assembly 12. Moreover, work tools supported above the partition assembly 12, such as the elevated storage units and the privacy screens 22, are preferably configured such that an uppermost surface of each of these work tools is positioned below a normal line of sight of a user in a standing position. These configurations and orientations provide a relatively uninterrupted, both private and collaborative, work conducive environment.

Figure 5:
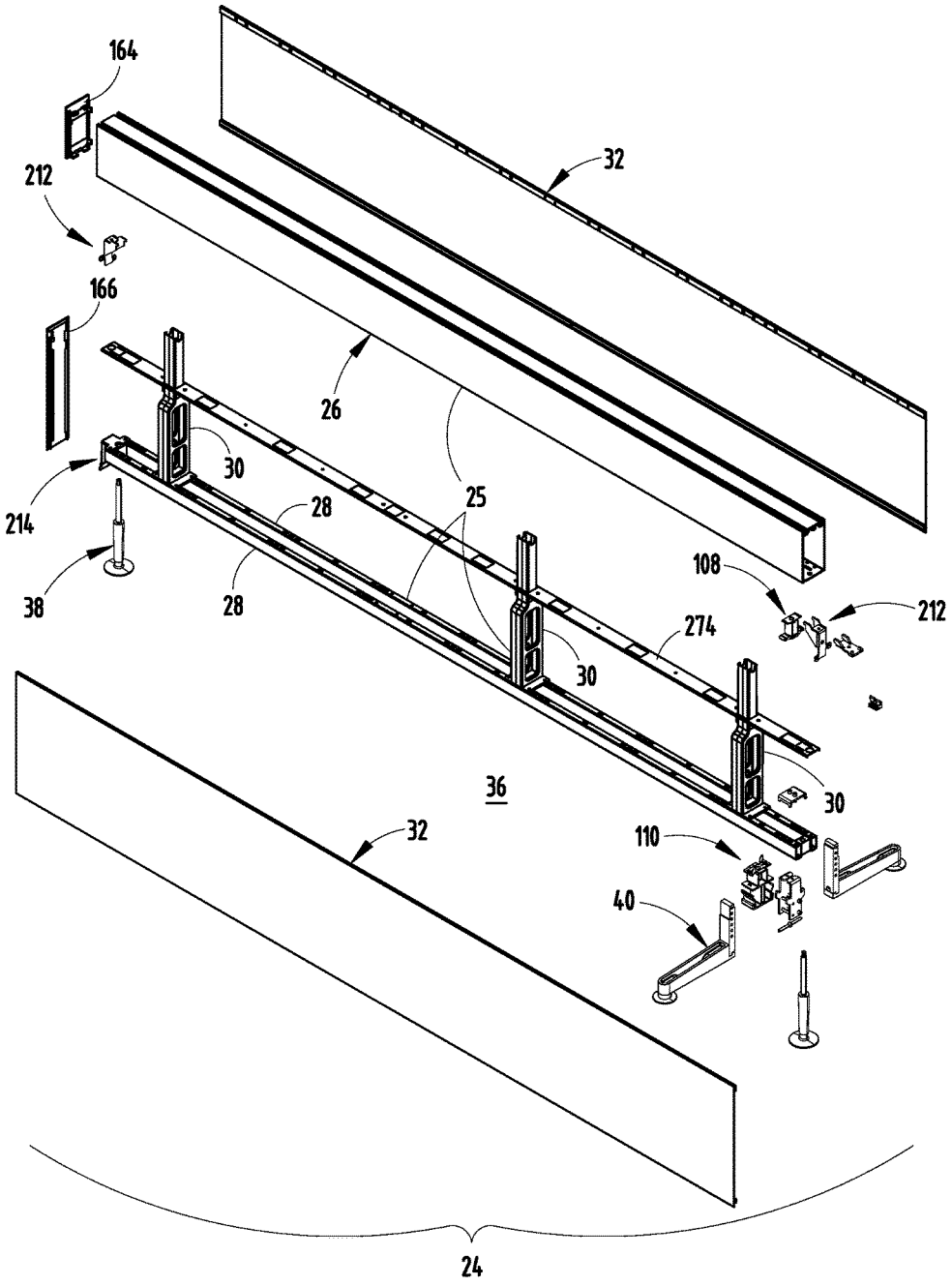
FIG. 5 is an exploded perspective view of the beam assembly.

The partition assembly 12 comprises a plurality of beam assemblies 24 (FIGS. 4 and 5) arranged and coupled with one another so as to subdivide and organize the floor plan area 14. Each beam assembly 24 comprises a frame assembly 25 that includes a horizontally-extending beam member 26, a pair of horizontally-extending lower frame members 28 spaced from one another and positioned below the beam member 26, and a plurality of vertical frame members 30 spaced along the length and coupling the beam member 26 and the lower frame members 28. Each beam assembly 24 further includes two cover members 32, which are juxtaposed from one another across the vertical frame members 30. The cover members 32 cooperate with the frame assembly 25 to form an open wireway 34 extending along the entire length of the beam assembly 24 and adapted to allow the routing of electrical and/or communication lines therein. Each beam assembly 24 is supported above a floor surface 36 via two first foot assemblies 38 and one or more second foot assemblies 40 coupled with and extending downwardly from the lower frame members 28.

The beam member 26 (FIG. 6A) of each beam assembly 24 includes a top wall 42, a bottom wall 44 and a pair of sidewalls 46 that cooperate to form an elongated, rectangularly-shaped closed beam structure. The top wall 42 includes a pair of spaced apart channels 48 each extending along the length of beam member 26 and having a neck portion 50 and a receiver portion 52, wherein the width of the neck portion 50 is less than the width of the receiver portion 52. The receiver portion 52 includes a pair of sidewalls 54 extending orthogonally downward from the top wall 42, a bottom wall 56 extending substantially parallel with the top wall 42, and a pair of angularly-extending bottom walls 58 extending between the sidewalls 54 and the bottom wall 56. A circularly-shaped alignment tube 60 is located within the interior 47 of the beam member 26 and defines an aperture 62 that receives an alignment pin 64 therein that aligns adjacent beam members 26 within the partition assembly 12. Alternatively, the alignment tube 60 (FIG. 6B) may include a longitudinally-extending opening 65. The bottom wall 44 includes a plurality of circularly-shaped work tool apertures 66 (FIG. 7) spaced along the length of the beam member 26. In the illustrated example, the work tool apertures 66 are provided in a pair of rows located proximate the sidewalls 46 and they are adapted to receive work tools supporting assemblies therein, as discussed below, and 90° beam connections, wherein beam assemblies 24 are coupled to one another in original orientations. The bottom wall 44 of each beam member 26 further includes a plurality of rectangularly-shaped vertical frame member apertures 68 spaced along the length of the beam member 26. It is noted that the beam member 26 is preferably formed via an extrusion process, however, other suitable methods of manufacture may be utilized.

Figure 8A:
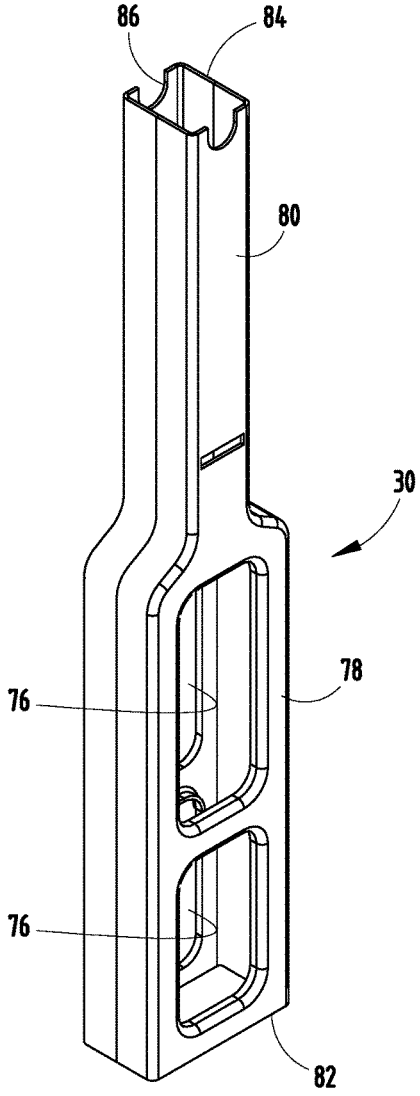
FIG. 8A is a perspective view of a vertical frame member of the beam assembly.
Figure 8B:
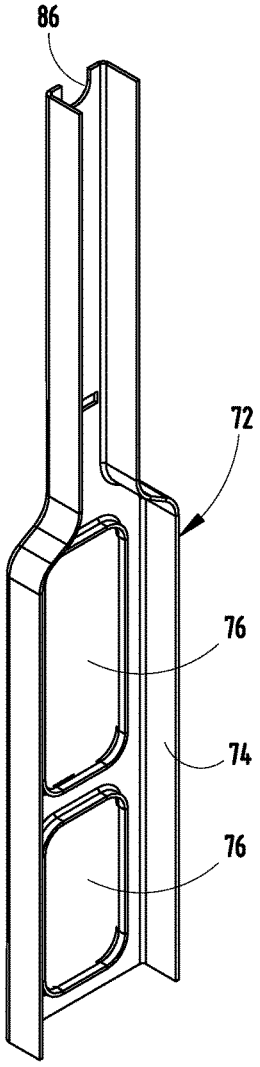
FIG. 8B is a perspective view of a portion of the vertical frame member.

As best illustrated in FIGS. 8A and 8B, each vertical frame member 30 comprises two halves 72 each having a pair of sidewalls 74 each being resistance welded with a corresponding opposite half 72. Each vertical frame member includes a pair of apertures 76 extending therethrough and adapted to receive electrical and communication wire routing. In the illustrated example, each vertical frame member 30 includes a lower portion 78 that includes the apertures 76 and a necked-down upper portion 80. Each vertical frame member 30 further includes a lower end 82 and an upper end 84. The upper end 84 includes a pair of arcuately-shaped recesses 86.

Figure 9:
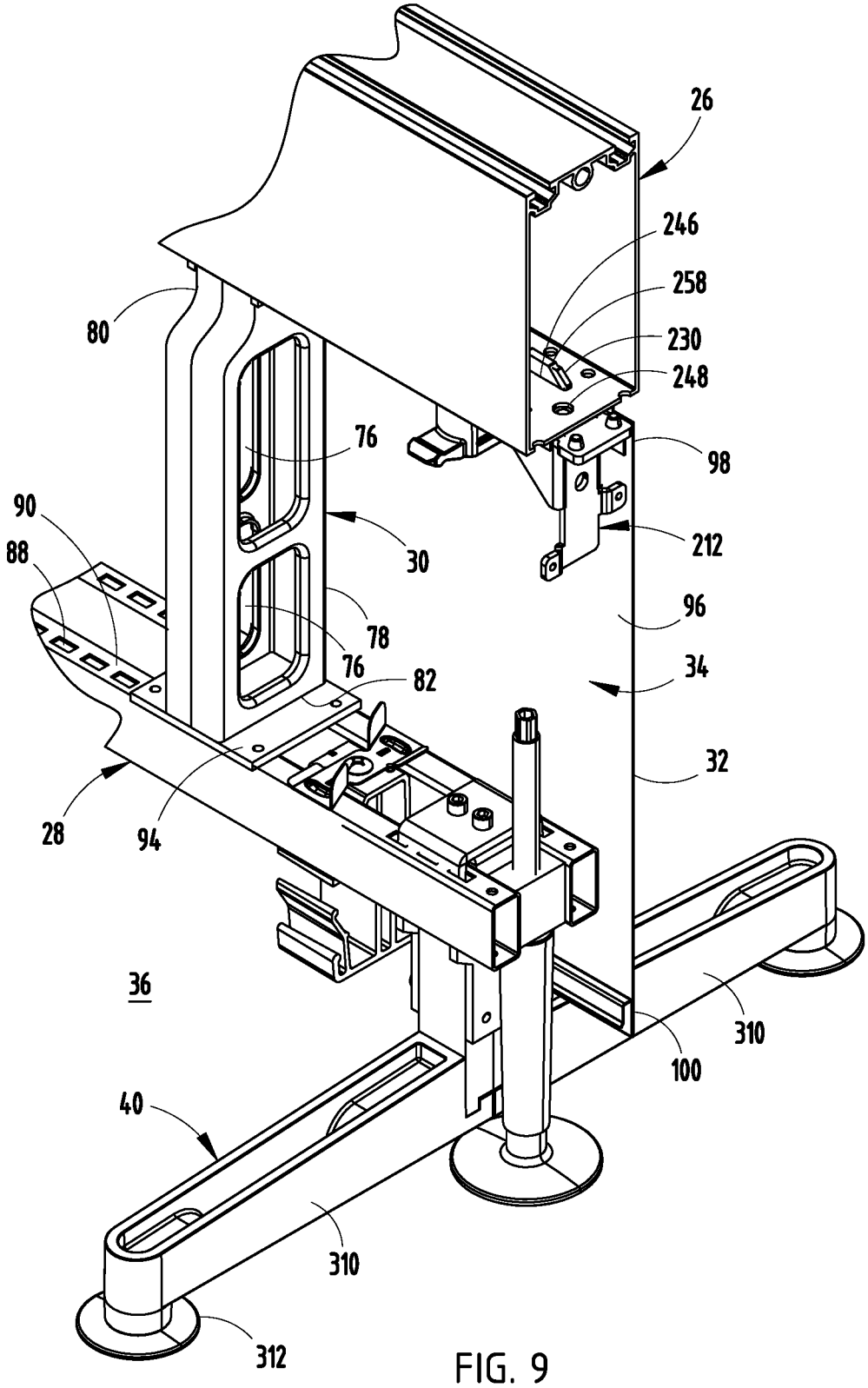
FIG. 9 is a partial perspective view of the beam assembly with the cover removed therefrom to show interior components thereof.
Figure 29A:
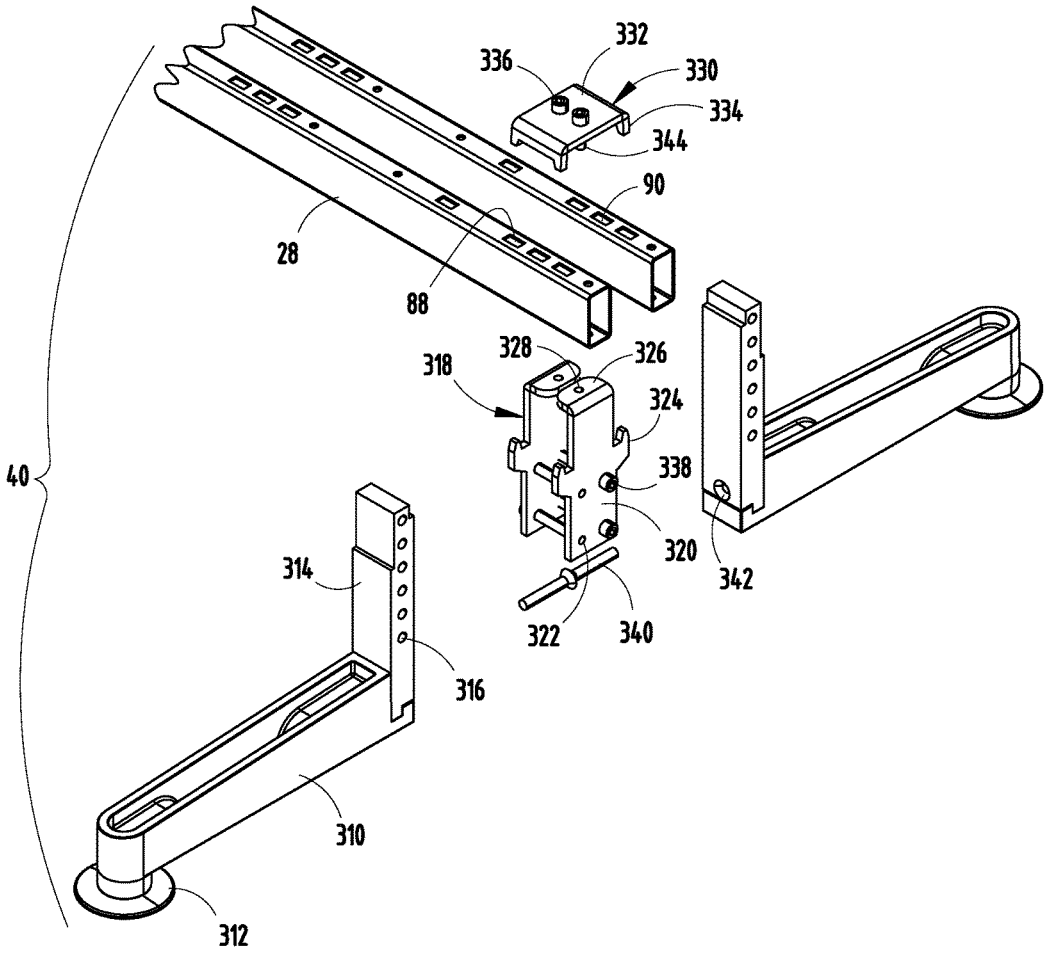
FIG. 29A is an exploded perspective view of a second foot assembly.
Figure 29B:
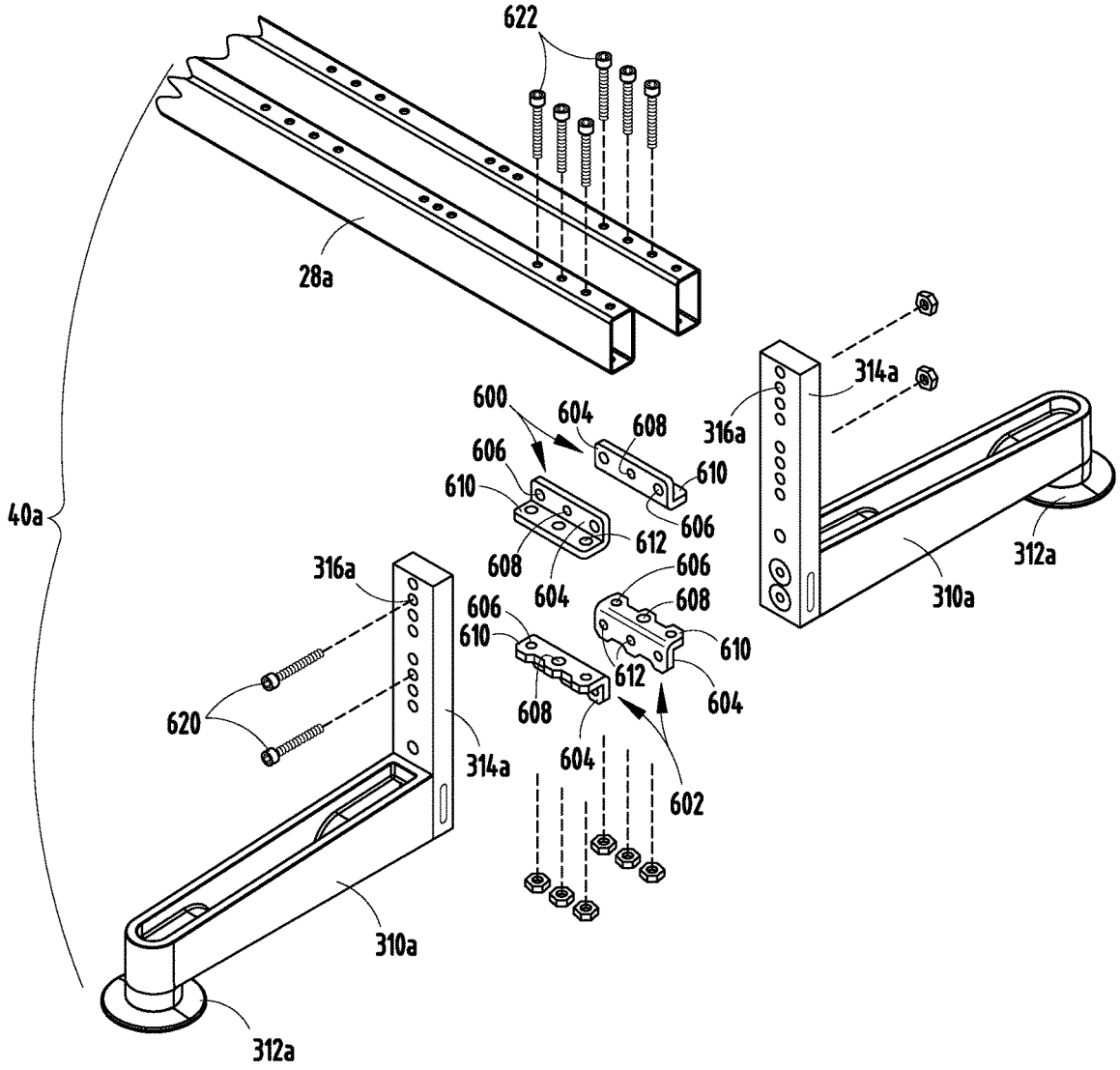
FIG. 29B is an exploded perspective view of an alternative embodiment of the second foot assembly.

Each of the lower frame members 28 (FIG. 9) are provided a rectangular cross-sectional configuration and include a plurality of rectangular-shaped apertures 88 located within and spaced along the length of an upper or top surface 90, or alternatively circularly-shaped apertures as illustrated in FIG. 29B. Each of the lower frame members 28 are preferably formed via a roll form process, however, other suitable forms of manufacture may be utilized. Further, each vertical frame member 30 may be constructed by weldably securing each of the two halves 72 in a back-to-back relationship.

Figure 6A:
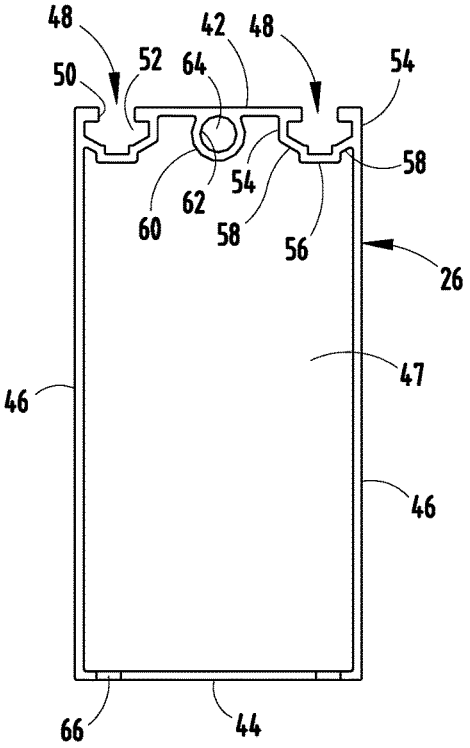
FIG. 6A is an end view of a beam of the beam assembly.
Figure 6B:
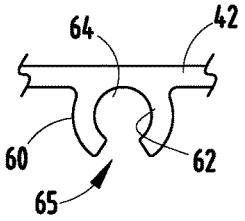
FIG. 6B is a partial end view of an alternative embodiment of an end portion of the beam.
Figure 7:
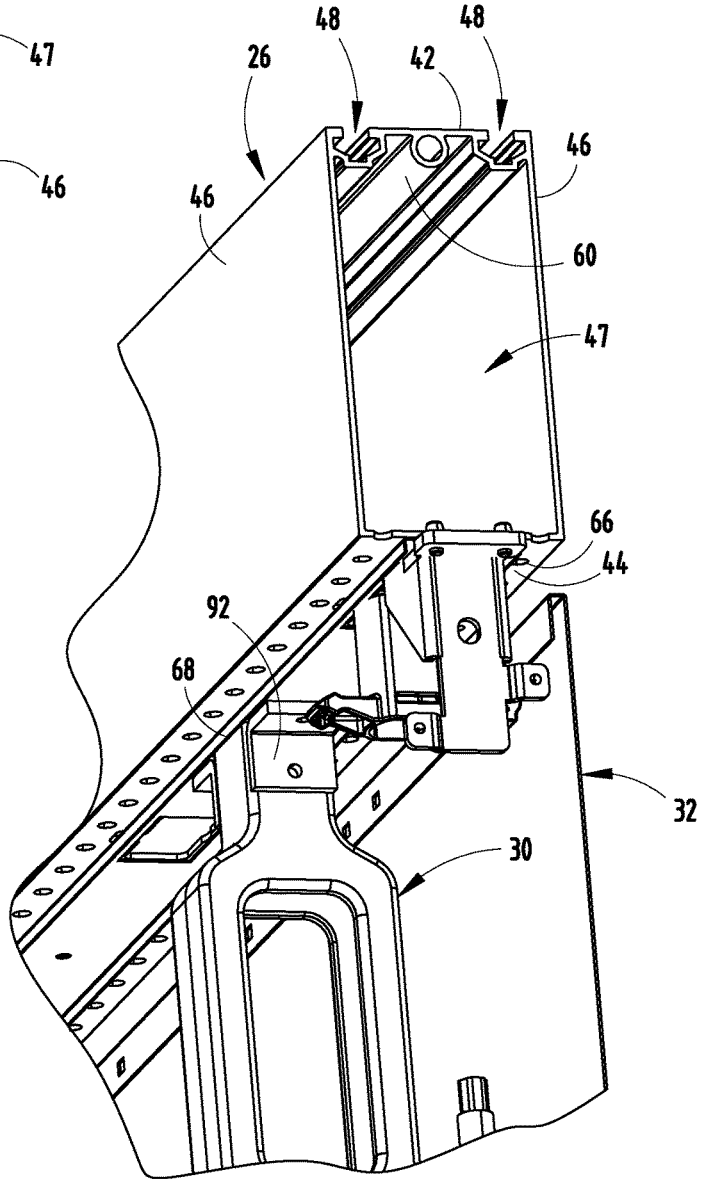
FIG. 7 is a partial perspective view of the beam assembly with a cover member of the beam assembly removed to show interior components thereof.
Figure 8C:
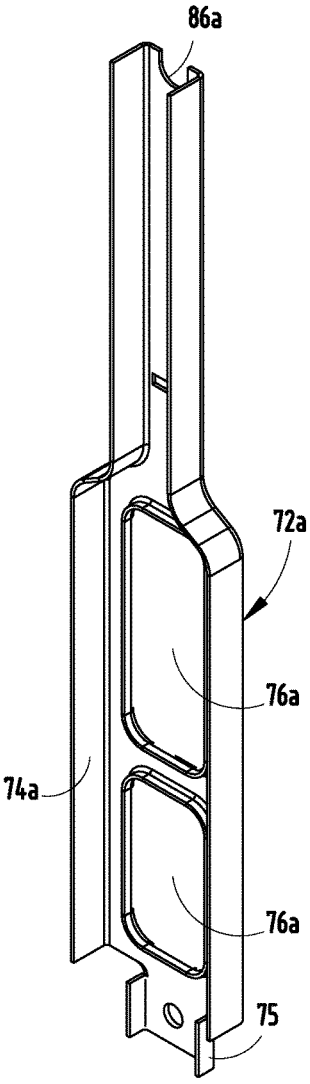
FIG. 8C is a perspective view of an alternative embodiment of the portion of the vertical frame member.

In assembly, each of the vertical frame members 30 is positioned such that the upper portion 80 of each of the vertical frame members 30 extends through the corresponding vertical frame member aperture 68 of the beam member 26. As best illustrated in FIG. 10, the upper end 84 of each of the vertical frame members 30 cooperates with the interior surface of the top wall 42 of the beam member 26 to form an interference fit between the vertical frame member 30 and the beam member 26. Alternatively, a grommet 73 (FIG. 10A) is located between the top end of the vertical frame member 30, creating the two halves 72 in a back-to-back relationship, and the beam 26 to reduce sounds caused by frictional engagement therebetween. The grommet 73 includes an arcuately-shaped body portion 75 that is received within the recesses 86, and a pair of engagement legs 77 that engage along a length of the vertical frame member 30. The grommet 73 preferably comprises a plastic or rubber material. In the illustrated example, the alignment tube 60 is received within the recesses 86 of the vertical frame member 30 with the upper end 84 of the vertical frame member 30 being received between the alignment tube 60 and the sidewalls 54 of channels 48. A pair of L-shaped coupler brackets 92 (FIG. 7) are then secured to each side of the corresponding vertical frame member 30 via a plurality of mechanical fasteners (not shown) and the bottom wall 40 of the beam member 26 by a plurality of mechanical fasteners 93 (FIG. 6A). The lower end 82 of each of the vertical frame members 30 is secured to the lower frame members 28 via a planar coupler bracket 94 (FIG. 9) that is weldably secured to the lower end 82 of the corresponding vertical frame member 30 and secured to the lower frame members 28 via a plurality of mechanical fasteners (not shown). Alternatively, the lower end 82 of each of the vertical frame members 30 may be weldably secured directly to the lower frame members 28. As best illustrated in FIG. 8C, each vertical member 30 may include a downwardly-extending C-shaped tab member 75 that may be weldably-secured to the lower frame members 28.

Figure 12:
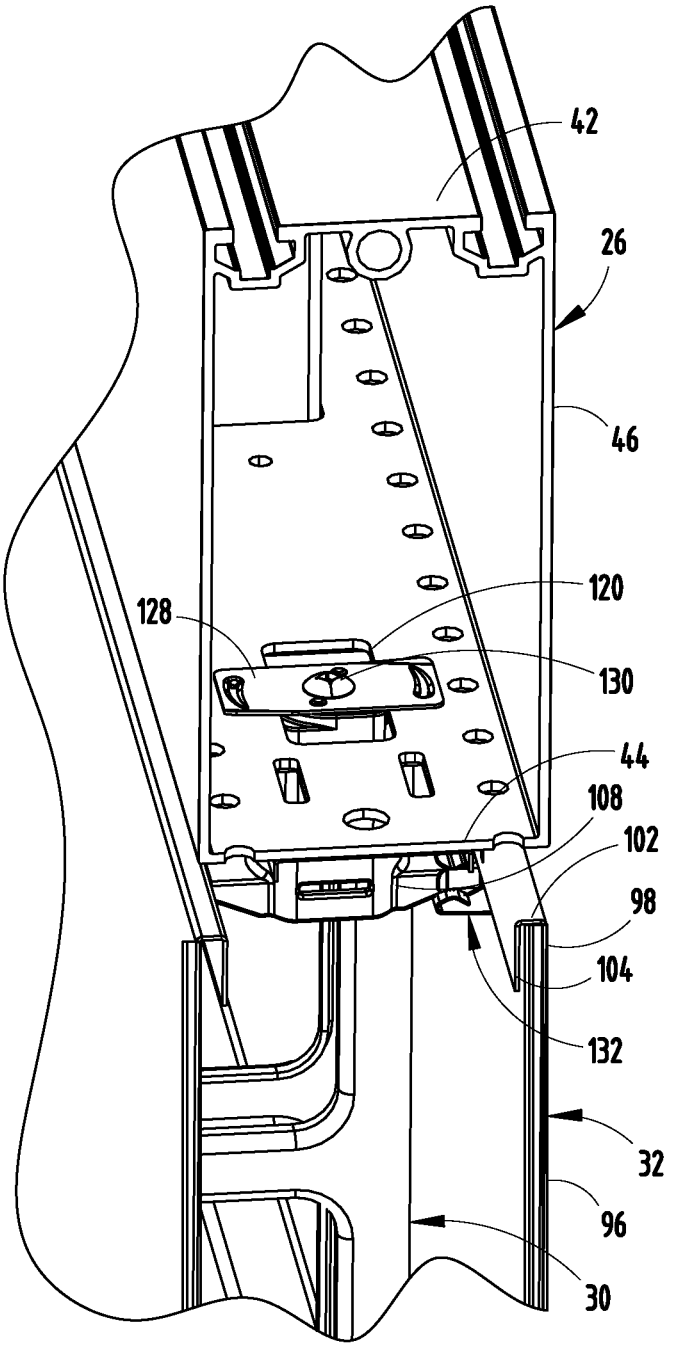
FIG. 12 is an enlarged, partial perspective view of the beam assembly.
Figure 13A:
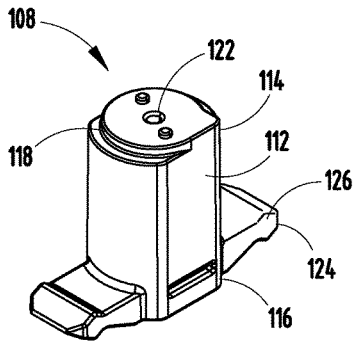
FIG. 13A is a perspective view of a first hanger member.
Figure 13B:
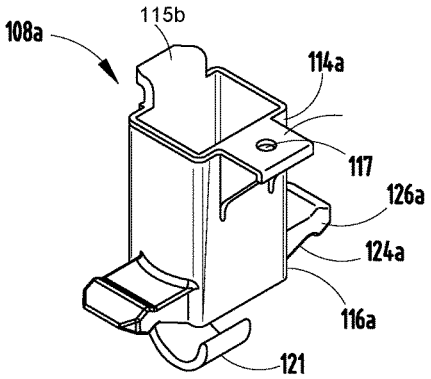
FIG. 13B is a perspective view of an alternative embodiment of the first hanger.
Figure 14A:
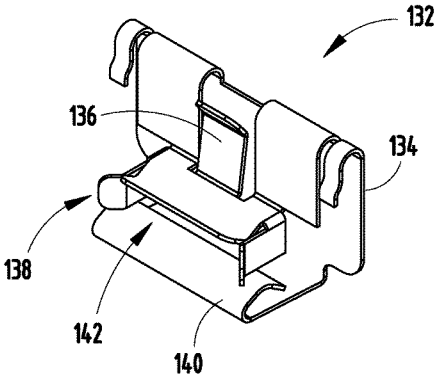
FIG. 14A is a perspective view of a clip member.
Figure 14B:
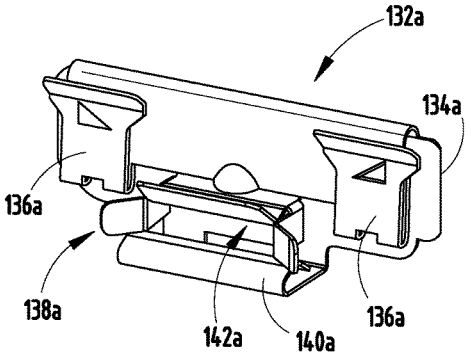
FIG. 14B is a perspective view of an alternative embodiment of the clip member.

Each cover or skin member 32 (FIG. 11) includes a planar body portion 96, an upper edge 98 and a lower edge 100. The upper edge 98 includes a downwardly-opening C-shaped channel having un upper edge 102 (FIG. 12) extending orthogonal to the body portion 96, and a downwardly-extending lip 104 extending substantially parallel with the body portion 96. The lower edge 100 of each of the cover members 32 includes a longitudinally-extending downwardly-opening hook portion 106 (FIG. 11A). Each of the cover members 32 is supported on the overall beam assembly 24 by an upper support member 108 and a lower support member 110. The upper support member 108 (FIGS. 12 and 13A) includes a tubularly-shaped body portion 112 having an upper end 114 and a lower end 116. The upper end 114 includes a raised cam-surface 118 that engages a rectangularly-shaped cover member support aperture 120 extending through the bottom wall 44 of the beam member 26. The upper end 114 further includes a centrally-located mechanical fastener-receiving aperture 122. The lower end 116 includes a pair of outwardly-extending legs 124 each having a bulbous outer end 126. The legs 124 cooperate with the body portion 112 to provide the upper support member 108 with an inverted T-shape. The upper support member 108 further includes a latch member 128 rotatably coupled to the upper end 114 of the body portion 112 via a screw 130 that is received with the aperture 122. In operation, the latch member 128 is movable between a first position wherein the latch member 128 is aligned with the corresponding rectangular shape of the cover member support aperture 122, and a second position, as illustrated in FIG. 12, wherein the latch member 128 supports the upper support member 108 from the bottom wall 144 of the beam member 26. Alternatively, the upper support member 108*a* (FIG. 13B) includes a rectangularly-shaped body portion 112 having an upper end 114*a* and a lower end 116*a*. The upper end 114*a* includes a pair of outwardly-extending support arms 115*a*, 115*b*, wherein one of the arms 115*b* includes an aperture 117 extending therethrough. The lower end 116*a* includes a pair of outwardly-extending legs 124*a* each having a bulbous outer end 126*a*. The legs 124*a* cooperate with the body portion 112*a* to provide the upper support member 108*a* with an inverted T-shape. In assembly, the upper support member 108*a* is coupled with the beam assembly 26 by inserting leg 115*a* into the aperture 120 of the beam 28, such that the leg 115*a* is supported by the lower wall 44 of the beam 28, and securing the other leg 115*a* to the beam 28 by inserting a mechanical fastener such as a screw (not shown) through the aperture 117. The upper support member 108*a* further includes an integrally formed, downwardly-extending, hook-shaped wire support 121 adapted to support electrical and communication lines. A plurality of cover mounting clips 132 (FIG. 14A) are spaced along the length of the upper edge 98 of a corresponding cover member 32 and engage both the upper edge 98 and the upper support member 108 to couple the associated cover member 32 within the overall beam assembly 24. Specifically, the clip 132 includes an elongated body portion 134 having an oval cross-sectional configuration, a flexibly resilient tab 136 extending substantially planar with the body portion 134, a guide 138 extending substantially orthogonally to the body portion 134 and a flexibly resilient spring portion 140 extending parallel with the guide 138 and spaced slightly therefrom. Alternatively, the clip 132*a* (FIG. 14B) includes a pair of flexibly resilient tabs 136*a* spaced across the body portion 134 from one another.

In assembly, the body portion 134 of each of the clips 132 is positioned between the lip 104 and the body portion 96 of the associated cover member 32 while the lip 104 is captured between the tab 136 and the body portion 134 of the clip 132, thereby securing the clip 132 with the cover member 32. In the illustrated example, the guide 138 includes a plurality of bent tabs that cooperate to form a rectangularly-shaped receiving cavity 142 that receives an end 126 of one of the legs 124 of the upper support member 108 therein, while the spring portion 140 is biased against an opposite side of the end 126 of the leg 124, thereby releasably securing the clip 132 and the associated cover member 32 with the overall beam assembly 24.

Figure 15:
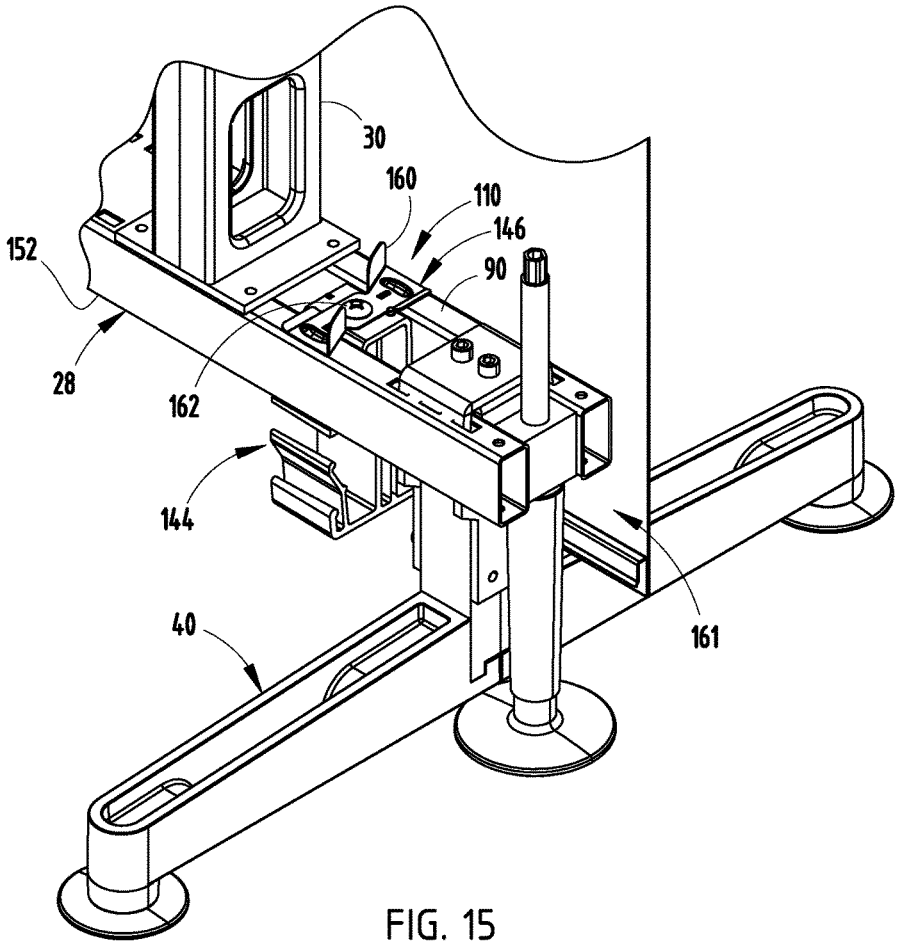
FIG. 15 is an enlarged partial perspective view of the beam assembly with the cover removed to show the interior components thereof.
Figure 16A:
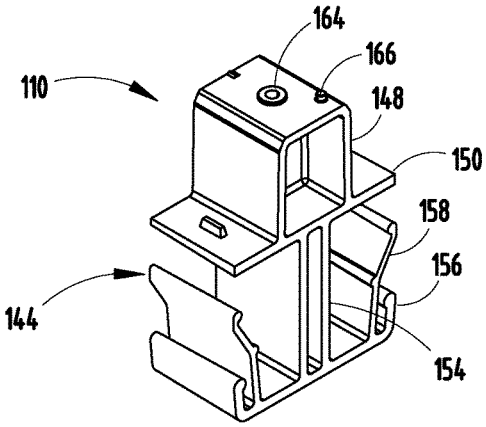
FIG. 16A is a perspective view of a second hanger member.
Figure 16B:
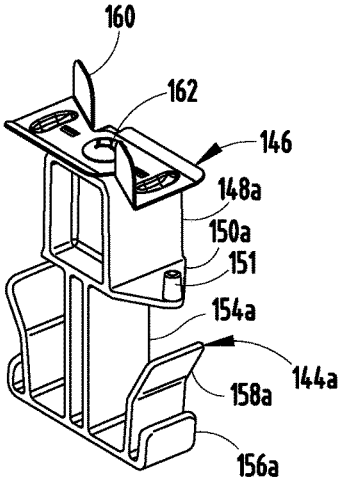
FIG. 16B is a perspective view of an alternative embodiment of the second hanger member.

As best illustrated in FIGS. 15 and 16A, the lower support member 110 includes a support 144 and a latch member 146. The support 144 includes an upper portion 148 that is received between the pair of lower frame members 28, a pair of abutment members 150 that extend outwardly from the upper portion 148 and abut a lower surface 152 of a corresponding lower frame member 28, a lower portion 154 extending downwardly from the upper portion 148, a cover supporting arm 156 spaced outwardly from the lower portion 154, and a wire guide arm 158 spaced outwardly from the lower portion 154 and inwardly from the cover support arm 156. In assembly, support 144 is held in position with respect to the lower frame members 28 by the latch member 146 that is movable between an assembly position, wherein the rectangularly-shaped latch member 146 is aligned with the space extending between the pair of lower frame members 28, and a latched position, wherein the latch member 146 extends orthogonal to the lower frame members 28 and abuts the upper surface 90 thereof. The latch member 146 includes a pair of upwardly-extending finger tabs 160 configured so as to allow the user to easily move the tab member between the assembly and latched positions. The latch member 146 is rotatably secured to the upper portion 148 of the support 144 by a screw 162 that extends into an aperture 164 of the support 144. A stop member 166 extends upwardly from the upper portion 148 of the support 144 and prevents over rotation of the latch member 146 with respect thereto. Each of the cover supporting arms 156 extends outwardly from the lower portion 154 and receives the hook portion 106 of the lower edge 100 of the associated cover panel 32 thereon, thereby positioning the cover member 32 from the lower support member 110. The wire guide arm 158 cooperates with the lower portion 154 to support electrical and communication lines therebetween. Specifically, the lower support member 110 assists in supporting electrical/communication lines running with a lower wireway 161 defined between the pair of covers 32 and located below the lower frame members 28, illustrated as the lowermost horizontally-extending frame member of the frame assembly 25. It is noted that the wireway 161 is also adapted to house power blocks and adapters therein. It is further noted that both the wireway 161 as well as the wireway 34 extend uninterrupted between adjacent beam assemblies 24. Alternatively, the lower support member 110*a* (FIG. 16B) includes triangularly-shaped abutment members 150 each having an upwardly-extending pin 151 that is received within one of the corresponding apertures 88.

Each cover member 32 is assembled with the overall beam assembly 24 by placing the hook portion 106 of the lower edge 100 of the cover member into engagement with the cover support arm 156 of each of the corresponding lower support members 110 and then rotating the upper edge 98 of the cover member 32 inwardly toward the vertical frame members 30 until the clips 132 releasably engage the legs 124 of the associated upper support members 108. Once assembled, the top edge 98 of each cover member 32 cooperates with the bottom wall 44 of the beam 26 to form a wire routing gap 163 (FIG. 11) therebetween. The wire routing gap 163 allows the passage of wires between the covers 32 and the beam 26 and communication and electrical lines to be easily routed from the wireways 34, 161 to a location in close proximity to the user. In the illustrated example, the gap 163 is approximately ⅞ inch in width and runs along the entire length of the beam assembly 24, however, other widths and lengths may be utilized depending on a particular application or requirement.

Figure 17:
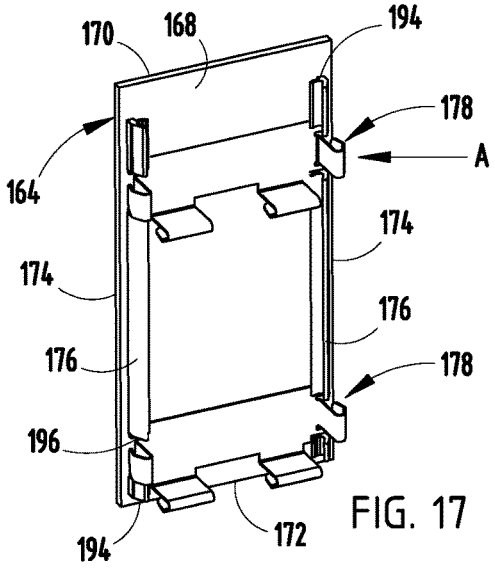
FIG. 17 is a perspective view of an upper end cover member.
Figure 18:
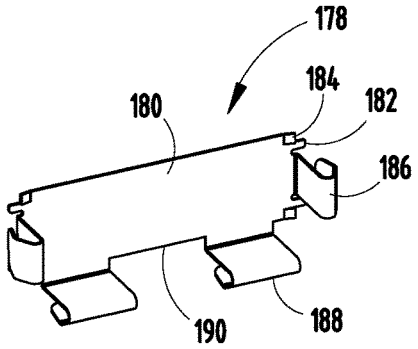
FIG. 18 is a perspective view of a clip member utilized to support the upper end cover member.

Each beam assembly 24 that is positioned at an end of a total partition assembly 12 is provided with end cover or skin members including a top end cover 164 (FIG. 5) that covers an end of the associated beam member 26, and a bottom end cover 166 that covers the wireway 34. The top end cover 164 (FIG. 17) includes a panel portion 168 having a top edge 170 and a bottom edge 172 that align with the top wall 42 and the bottom wall 44 of the beam member 26, respectively, when the top end cover 164 is secured to the beam member 26. The panel portion 168 further includes side edges 174 each having an inwardly turned channel 176 utilized to secure a clip member 178 thereto. The clip member 178 (FIG. 18) includes a planar body portion 180, pairings of alignment tabs 182 extending outwardly from side edges 184 of the body portion 180, a first pair of flexibly resilient spring arms 186 positioned between the pairings of alignment tabs 182 and extending orthogonally inward from the body portion 180, and a second pair of spring tabs 188 extending from another side edge 190 and orthogonally from the body portion 180. In assembly, a pair of the clip members 178 are each coupled with the top end cover 168 by locating the alignment tabs 182 of each of the clip members 178 within the channels 176 of the top end cover 164. During the sliding assembly motion, the first pair of spring arms 186 of the associated clip member 178 is pressed in an inward direction A such that the arms 186 may pass by the ends 194 of the channels 176. Multiple gaps 196 located along the length of the channels 176 receive the first pair of spring arms 186, thereby allowing the spring arms 186 to flex in an outward direction and secure the position of the clip members 178 along the length of the top end cover 164. The top end cover 164 is assembled with the beam member 26 by aligning the top end cover 164 with an end of the beam member 26 such that the tabs 186 and 188 of the clip members 178 are received within the interior 47 of the beam member 26. Specifically, the clip members 178 are aligned with the beam member 26 such that the first pair of spring arms 186 of each of the clip members 178 frictionally engages an inner surface of the sidewalls 46 of the beam member 26, while the second pair of spring tabs 188 of the upwardly-located clip member 178 abuts an inner surface of the bottom wall of the channels 48 and the second pair of spring arms 188 of the downwardly located clip member 178 abuts an inner surface of the bottom wall 44 of the beam member 26.

Figure 19:
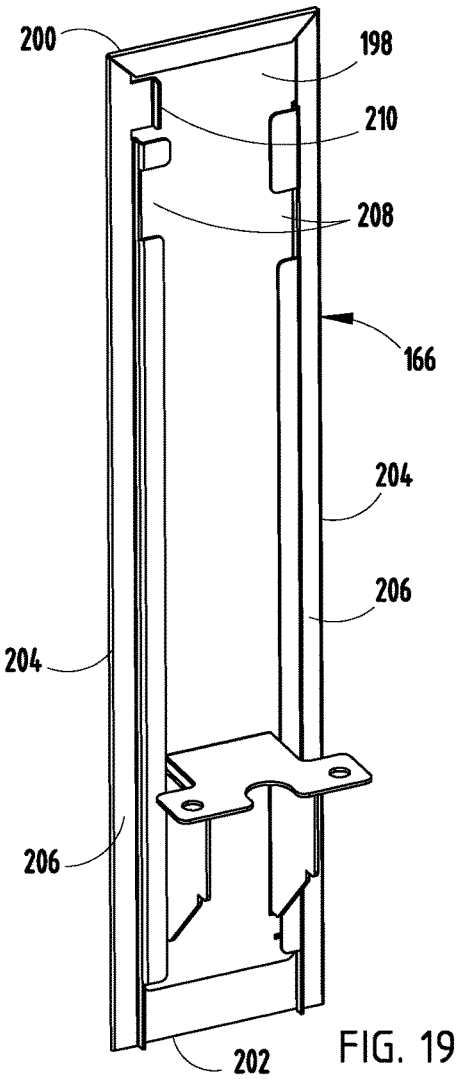
FIG. 19 is a perspective view of a lower end cover member.
Figure 20A:
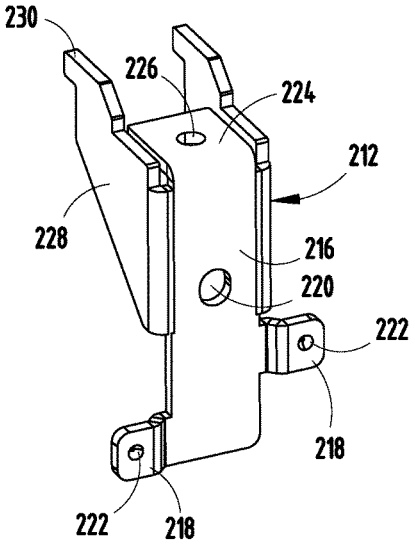
FIG. 20A is a perspective view of a coupler bracket.
Figure 20B:
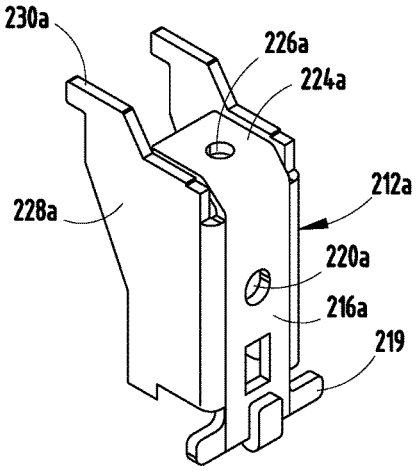
FIG. 20B is a perspective view of an alternative embodiment of the coupler bracket.
Figure 24:
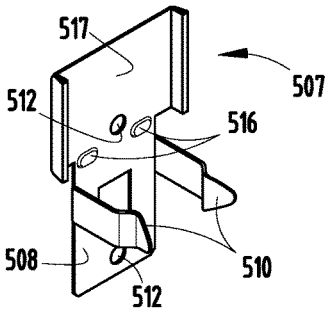
FIG. 24 is a perspective view of an alternative embodiment of the upper attachment bracket.

In a first embodiment, the bottom end cover 166 (FIG. 19) includes a body portion 198 having a top edge 200 and a bottom edge 202 that align with the upper edge 98 and lower edge 100 of the cover members 32, respectively, when the bottom end cover 166 is secured to the overall beam assembly 24. The body portion 198 further includes a pair of side edges 204 each including an inwardly-opening channel 206 extending along the length of the bottom end cover 166. Each of the channels 206 includes a gap 208 located along the length thereof while receiving a support structure therein, as described below. One of the channels 206 further includes an inwardly-extending stop tab 210. The bottom end cover 166 is attached to the overall beam assembly 24 via an upper coupler bracket 212 (FIG. 5) and a lower coupler bracket 214. The upper coupler bracket 212 (FIG. 20A) includes a planar body portion 216 having a pair of arms 218 extending from opposite sides of the body member 216 and staggered from one another along the length of the body portion 216. In the illustrated example, the body portion 216 includes an aperture 220 extending therethrough while each of the arms 218 include raised features 222. The upper coupler bracket 212 also includes a top wall 224 extending orthogonally from the body portion 216 and having an aperture 226 extending therethrough. The upper coupler bracket 212 further includes a pair of angled sidewalls 228 ending in a pair of tabs 230 extending upwardly from the top wall 224. In an alternative embodiment, as best illustrated in FIG. 20B, an upper coupler bracket 212*a* is similar in construction to the upper coupler bracket 212 with the main exception being the replacement of the pair of offset arms 218 with a pair of aligned arms 219 that are releasably engaged by spring arms 510 (FIG. 24) of a clip member 507, as described below.

Figure 21:
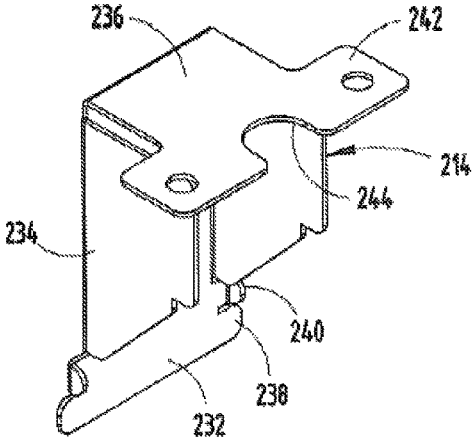
FIG. 21 is a perspective view of an attachment bracket utilized to connect the lower end cover member to the overall beam assembly.

The lower coupler bracket 214 (FIG. 21) includes a planar body portion 232, a pair of sidewalls 234 extending orthogonally from the body portion 232, and a top wall 236 extending orthogonally from the body portion 232. The body portion 232 includes a pair of alignment tabs 238 extending outwardly from a lower portion of the body portion 232, a pair of securement tabs 240 extending outwardly and orthogonally from the body portion 232, and located between the sidewalls 234 and the alignment tabs 238 along the length of the body portion 232. The top wall 236 includes a pair of outwardly-extending support tabs 242 bifurcated by an arcuately-shaped relief 244.

Figure 22:
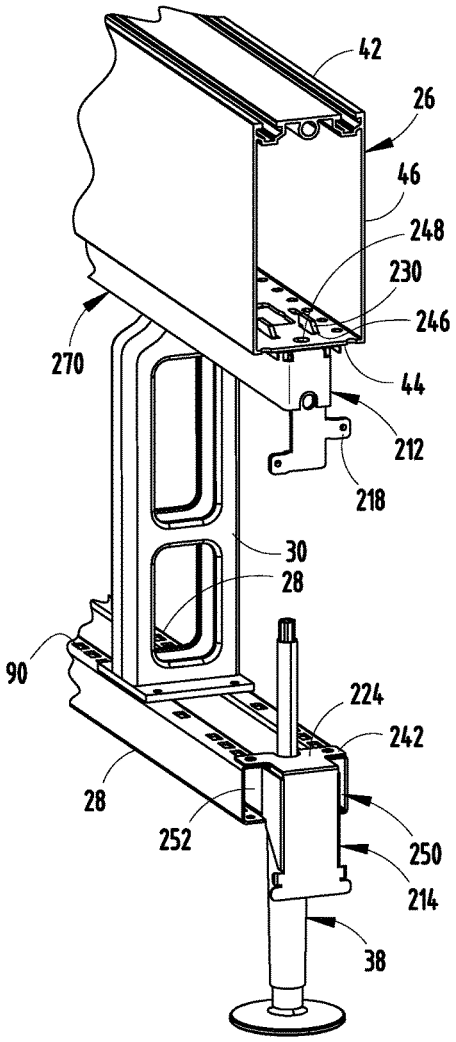
FIG. 22 is a partial perspective view of the beam assembly with both cover members removed to show interior components thereof.

In assembly, the upper coupler bracket 212 (FIG. 22) is assembled with the beam member 26 by extending the tabs 230 of the upper coupler bracket 212 into corresponding apertures 246 located within the bottom wall 44 of the beam member 26 and securing the upper coupler bracket 212 via a mechanical fastener, such as a bolt, extending through an aperture 248 located within the bottom wall 44 of the beam member 26 and the aperture 226 located within the top wall 224 of the upper coupler bracket 212. The lower coupler bracket 214 is assembled to the frame assembly 25 by aligning the lower coupler bracket 214 with the lower frame members 28, such that the sidewalls 234 of the lower coupler bracket 214 are received within the interior 250 of the corresponding frame members 28 and guide along the respective interior walls 252 thereof, while the support tabs 242 of the top wall 224 are proximal to and secured to the upper surface 90 of each of the lower frame members 28 via mechanical fasteners such as bolts or screws (not shown). The bottom end cover 166 is then secured to the overall beam assembly 24 by sliding the channels 206 of the bottom end cover 166 into engagement with the arms 218 of the upper coupler bracket 212 and the securement tabs 240 of the lower coupler bracket 214. The alignment tabs 238 of the lower coupler bracket 214 serve to align and guide the bottom end cover 166 as it is slidably assembled with the brackets 212, 214, while the stop tab 210 of the bottom end cover 224 abuts the upper coupler bracket 212, thereby vertically aligning the bottom end cover 166 with the overall beam assembly 24. The arcuately-shaped relief 244 within the top wall 236 of the lower coupler bracket 214 provides clearance for the first foot assembly 38.

Figure 23:
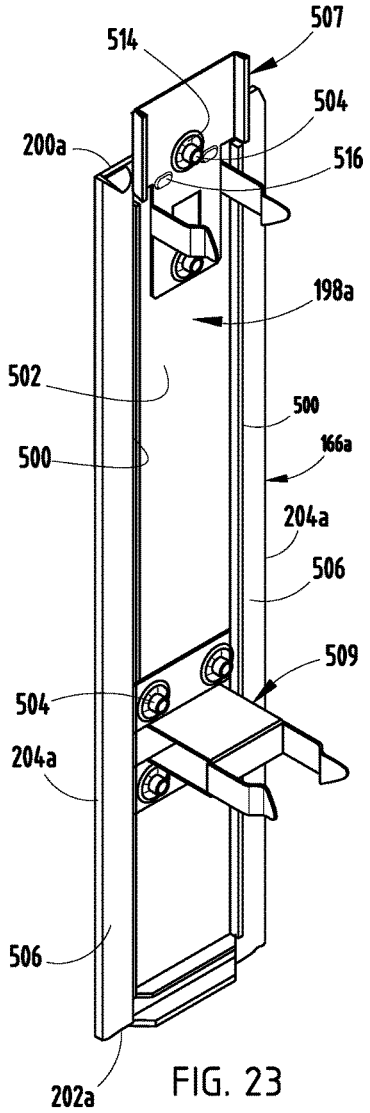
FIG. 23 is a perspective view of an alternative embodiment of the lower end cover member.
Figure 25:
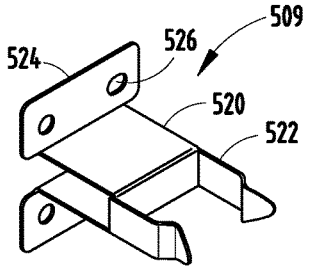
FIG. 25 is a perspective view of an alternative embodiment of the lower attachment bracket.

In a second embodiment, the bottom end cover 166*a* (FIG. 23) includes a body portion 198*a* having a top edge 200*a* and a bottom edge 202*a* that align with the upper edge 98 and lower edge of the cover members 32, respectively, when the bottom end cover 166*a* is secured to the overall beam assembly 24. Since the bottom end cover 166*a* is similar to the previously-described bottom end cover 166, similar parts appearing in FIG. 5 and FIG. 23, respectively, are represented by the same, corresponding reference numerals, except for the suffix "a" in the numerals of the latter. The body portion 198*a* further includes a pair of side edges 204*a*, a pair of integrally formed, longitudinally-extending alignment walls 500 extending inwardly from an inner surface 502 of the body portion, and a plurality of integrally-formed alignment bosses 504 extending inwardly from the inner surface 502. A pair of elastically-resilient bumper members 506 extend longitudinally along the body portion 198*a* and are located between the respective alignment walls 500 and side edges 204*a*. The bottom end cover 166*a* is attached to the overall beam assembly 24 via an upper clip member 507 (FIG. 24) and a lower clip member 509 (FIG. 25). The upper clip member 507 includes a body portion 508 and a pair of orthogonally and inwardly-extending spring arms 510 that engage above the arms 219 of the upper coupler bracket 212*a*, thereby coupling the bottom end cover 166*a* with the overall beam assembly 24. The body portion 508 includes a plurality of alignment apertures 512 that receive the alignment bosses 504 therein. The alignment apertures 512 may include integrally-formed quick connectors (not shown), or may be secured about the alignment bosses 504 via separate mechanical fasteners, such as quick-connect washers 514. The body portion 508 further includes a pair of elongated alignment apertures 515 that receive a pair of alignment bosses 516 therein. The upper clip member 507 further includes an integrally-formed light shield 517 extending upwardly from the body portion 508. The light shield 517 is positioned between the upper edge 200*a* of the bottom wall 44 of the beam member 26 when the bottom end cover 166*a* is coupled with the overall beam assembly 24. The lower clip member 509 (FIG. 25) includes a box-shaped body portion 520 and a pair of inwardly-extending spring arms 522 that engage a portion of an adjustment block 302*a* (FIG. 26) of a foot assembly 38, as described below, thereby coupling the bottom end cover 166*a* with the overall beam assembly 24. The lower clip member 509 further includes a pair of flanges 524 extending orthogonally to the body portion 520 and including alignment apertures 526 that receive the alignment bosses 504 therein. The alignment apertures 526 may include integrally-formed quick connectors (not shown), or may be secured about the alignment bosses 504 by separate mechanical fasteners, such as quick-connect washers 514.

Figure 20C:
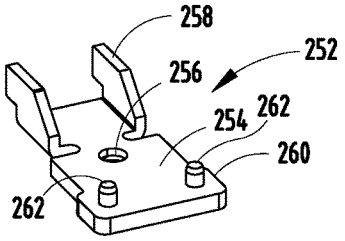
FIG. 20C is a perspective view of a connector bracket.

As best illustrated in FIG. 20C, a 90° end coupler bracket 252 can replace the upper coupler bracket 212 to secure the end of a beam member 26 to another beam member 26 in a 90° configuration. In the illustrated example, the 90° end coupler bracket 252 includes a planar body portion 254 having an aperture 256 and a pair of rearwardly-extending tabs 258 extending orthogonally from the body portion 254. The 90° end coupler bracket 252 is assembled with the beam member 26 by locating the tabs 258 within the apertures 246 of the beam 26 and securing the 90° end coupler bracket 252 with the beam member 26 via hardware, such as a bolt extending through aperture 248 of the beam 26, and the aperture 256 of the 90° end coupler bracket 252. In the illustrated example, the body portion 254 of the end coupler bracket 252 includes an end portion 260 that extends outwardly beyond an end of the beam member 26 once the 90° end coupler bracket 252 is secured thereto, and that includes a pair of guide pins 262 extending upwardly therefrom, that engage the circularly-shaped apertures 66 (FIG. 7) on the underside of the bottom wall 44 of the adjacent beam member 26 when the adjacent beam assemblies 24 are secured to one another in a 90° configuration. The adjacent beam assemblies are secured to one another in an in-line configuration via bolts and/or screws that extend through the apertures 220 and 222 of the upper coupler bracket 212 of each of the corresponding and aligned beam assemblies 24.

Figure 20D:
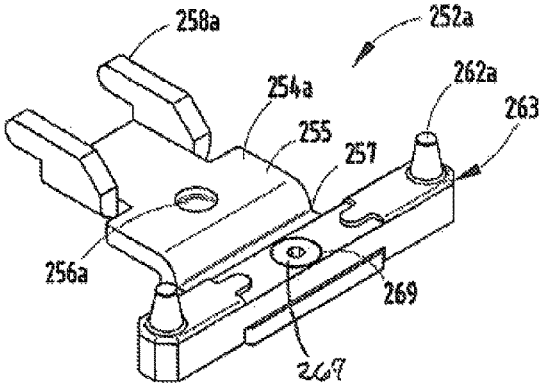
FIG. 20D is a perspective view of an alternative embodiment of the connector bracket.
Figure 20E:
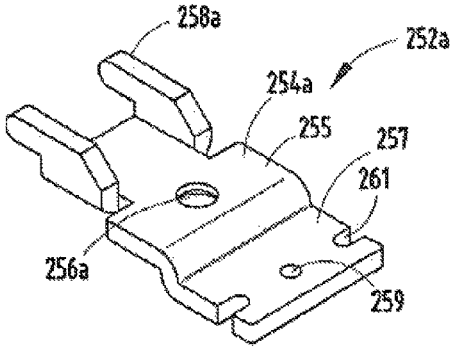
FIG. 20E is a perspective view of a first portion of the alternative connector bracket.
Figure 20G:
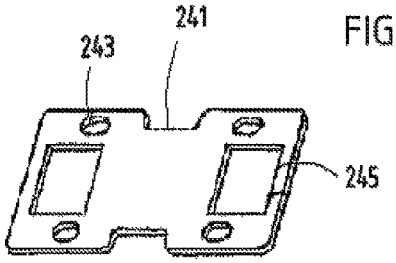
FIG. 20G is a perspective view of an end-to-end connector bracket.
Figure 20F:
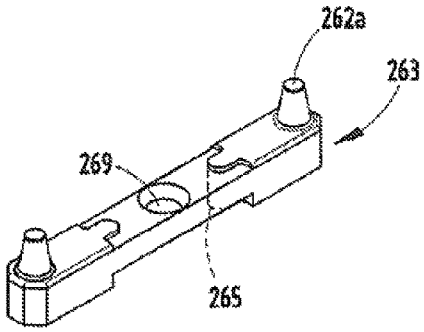
FIG. 20F is a perspective view of a second portion of the alternative connector bracket.

As best illustrated in FIGS. 20D-20F, an alternative 90° end coupler bracket 252*a* can replace the upper coupler bracket 212 to secure the end of a beam member 26 to another beam member 26 in a 90° configuration. In the illustrated example, the alternative 90° end coupler bracket 252*a* includes a planar body portion 254*a* having an upper portion 255 with an aperture 256*a* and a lower portion 257 with an aperture 259 and a pair of juxtaposed U-shaped notches 261. A pair of rearwardly-extending tabs 258*a* extends orthogonally from the body portion 254*a*. The bracket 252*a* further includes an engagement assembly 263 having a pair of upwardly-extending guide pins 262*a* and a pair of downwardly-extending U-shaped engagement portions 265 that are received within the notches 261. A screw 267 extends through an aperture 269 and is threadably received into the aperture 259. The 90° end coupler bracket 252*a* is assembled with the beam member 26 in a similar manner to the 90° end coupler bracket 252 as discussed above. The alternative coupler bracket 252*a* may also be utilized for end-to-end beam connections with the end bracket 241 (FIG. 20G). The end bracket 241 includes a squared, generally figure-eight configuration with pairs of apertures 243 located at opposite ends to receive the guide pins 262*a* of a pair of coupler brackets 252*a* therein, and apertures 245 that align with apertures within the beam 26.

Figure 26:
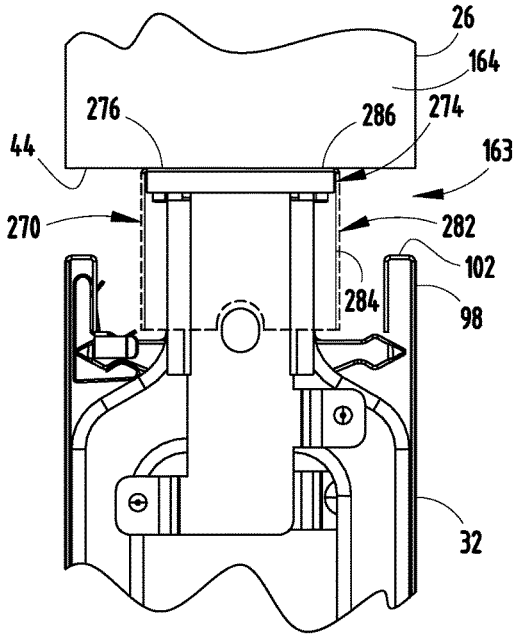
FIG. 26 is a partial end view of the beam assembly.
Figure 27:
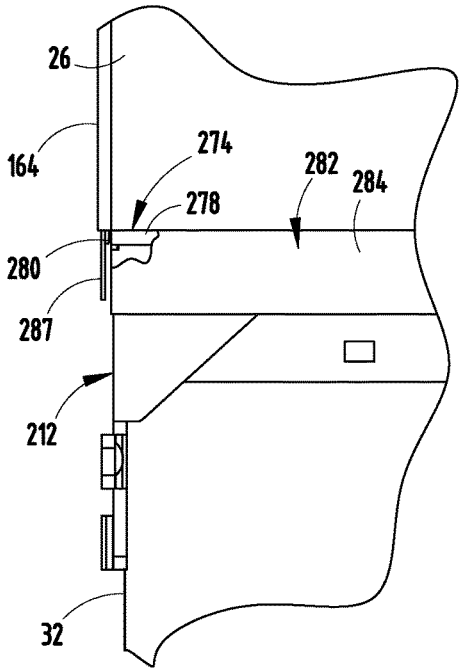
FIG. 27 is a partial side view of the beam assembly, with a portion of a light seal cut away to show a light seal support member.

As best illustrated in FIGS. 26 and 27, a light seal assembly 270 is provided to prevent light from passing through the wire routing gap 163 defined between the top edge 98 of the coupler panel 32 and the bottom wall 44 of the beam member 26. The light seal assembly 270 includes a semi-rigid light seal support member 274 that extends along the length of the beam assembly 24 and is secured to the bottom wall 44 of the beam member 26 by a plurality of mechanical fasteners, such as screws (not shown). The support member 274 includes a top wall 276 that abuts the bottom wall 44 of the beam member 26, a pair of longitudinally-extending sidewalls 278, and an end wall 280 located at opposite ends of the support member 274. The support member 274 is constructed of a relatively thin steel, however, other suitable materials such as plastic may also be utilized. The light seal assembly 270 further includes a flexible light seal 282 having a downwardly-extending portion 284 that extends from the bottom wall 44 of the beam member 26 to a vertical point that is below the uppermost edge 98 of the cover panels 32, and that extends along the length of the beam assembly 24, and at both ends 287. The light seal 282 (FIG. 27) further includes a support portion 280. The light seal 282 is preferably constructed of a flexible material that allows easy access to the wireway 34 via the gap 163. As previously described above, the end portions 287 of the light seal 282 may be replaced by the light shield portion 517 of the upper clip member 507.

Figure 28A:
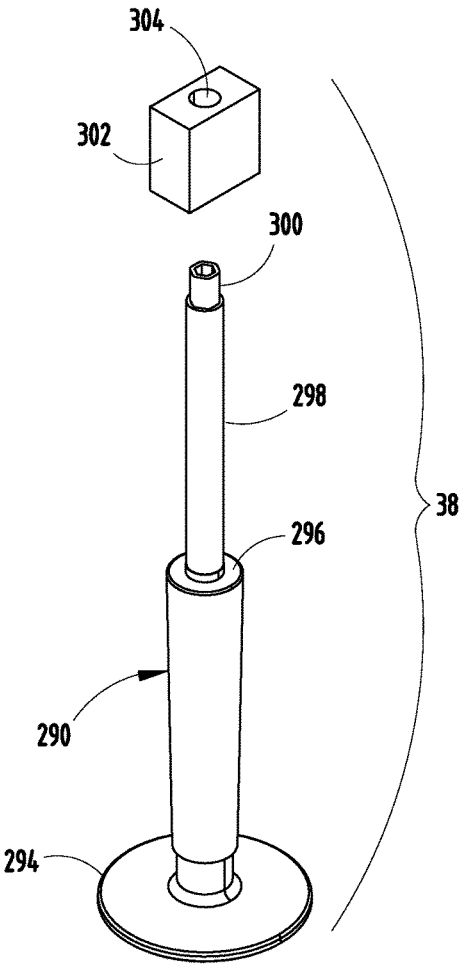
FIG. 28A is an exploded perspective view of a first foot assembly.
Figure 28B:
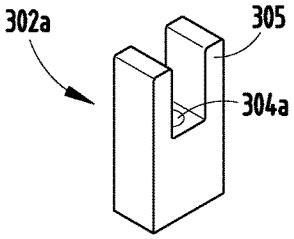
FIG. 28B is a perspective view of an alternative embodiment of an adjustment block of the first foot assembly.

The first foot assembly 38 (FIG. 28A) includes a pedestal 290 that includes a floor abutting foot member 294 and a threaded shaft 298. The threaded shaft 298 includes an adjustment nut integrally formed on a distal end thereof. The first foot assembly 38 further includes an adjustment block 302 having a threaded aperture 304 extending therethrough. In assembly, the adjustment block 302 is secured to and between the lower frame members 28 with the threaded shaft 298 being threadably received within the threaded aperture 304. Adjustment of the height of the beam assembly can be produced by hand turning of the pedestal or by utilizing a tool to engage the nut 300 of the threaded shaft 298, thereby adjusting the relative position of the adjustment block 302 along the length of the threaded rod 298. Alternatively, the adjustment block 302*a* (FIG. 28B) includes a pair of upwardly-extending projections 305 that extend above the lower frame members 28 and may be engaged by the spring arms 522 of the bracket 214*a*, thereby releasably coupling the bottom end cover 166*a* with the overall beam assembly 24.

The foot assembly 40 (FIGS. 9 and 29A) includes outwardly-extending arms 310 having floor engaging feet 312 secured thereto. Each arm 310 extends outwardly away from the general beam assembly 24 so as to provide lateral stability for the beam assembly 24 with respect to the supporting floor surface 36. The opposite end of each arm 310 includes an upwardly-extending adjustment block 314 fixedly secured to the associated arm 310 and including a plurality of bolt-receiving apertures 316 spaced along the length thereof. The foot assembly 40 further includes a pair of support brackets 318 each including a planar body portion 320 having a plurality of bolt-receiving apertures 322 extending therethrough, a pair of upwardly-opening hub portions 324 extending outwardly from opposite sides of the body portion 320, and a top wall 326 extending orthogonal to the body portion 320 and having an aperture 328 extending therethrough. The foot assembly 40 further includes a clamp member 330 having a planar body portion 332 and a plurality of downwardly-extending tabs 344 extending orthogonal to the body portion 332 and located at opposite corners thereto. Body portion 332 further includes a pair of apertures 336 extending therethrough.

An alternative foot assembly 40*a* (FIG. 29B) includes outwardly-extending arms 310*a* having floor engaging feet 312*a* secured thereto. Each arm 310*a* extends outwardly away from the general beam assembly 24 so as to provide lateral stability for the beam assembly 24 with respect to the supporting floor surface 36. The opposite end of each arm 310 includes an upwardly-extending adjustment block 314*a* fixedly secured to the associated arm 310*a* and including a plurality of bolt-receiving apertures 316*a* spaced along the length thereof. The foot assembly 40*a* further includes a pair of L-shaped upper attachment brackets 600 and a pair of L-shaped lower attachment brackets 602. Each upper attachment bracket 600 and lower attachment bracket 602 includes a first portion 604 and a second portion 610. In assembly, alignment bolts 620 are positioned through the bolt-receiving apertures, thereby vertically supporting the beam assembly 24, while a plurality of clamping bolts 622 are positioned within the apertures, thereby clamping the upper and lower attachment brackets 600, 602 to one another. Alternatively, the nuts associated with the bolts 620, 622 may be replaced by threaded apertures within brackets 600, 602.

In assembly, each arm 310 is secured to the supporting brackets 318 via bolts 338 that extend through the apertures 322 of the support brackets 318 and the apertures 316 of the adjustment blocks 314. The relative height of the support brackets 318 with respect to the arms 310 can be adjusted by selecting the appropriate apertures 316 within which the bolts 338 are placed. Bolts 338 are used to secure arms 310 to adjustment blocks 340. The support brackets 318 and the arms 310 are then assembled with the overall beam assembly 24 by placing a portion of the body portion 320 of the support brackets 318 and a portion of the adjustment blocks 314 between the lower frame members 28, such that the hub portions 324 of the support brackets 318 engage apertures (not shown) located in the bottom side of each of the lower frame members 28. The clamp member 330 is then secured to the support brackets 318 by placing the tabs 334 of the clamp member 330 into corresponding apertures 88 located in the top wall 90 of the lower frame members 28 and threading bolts 344 through apertures 336 of the clamp member 330 and into apertures 328 of the support brackets 318.

Figure 30:
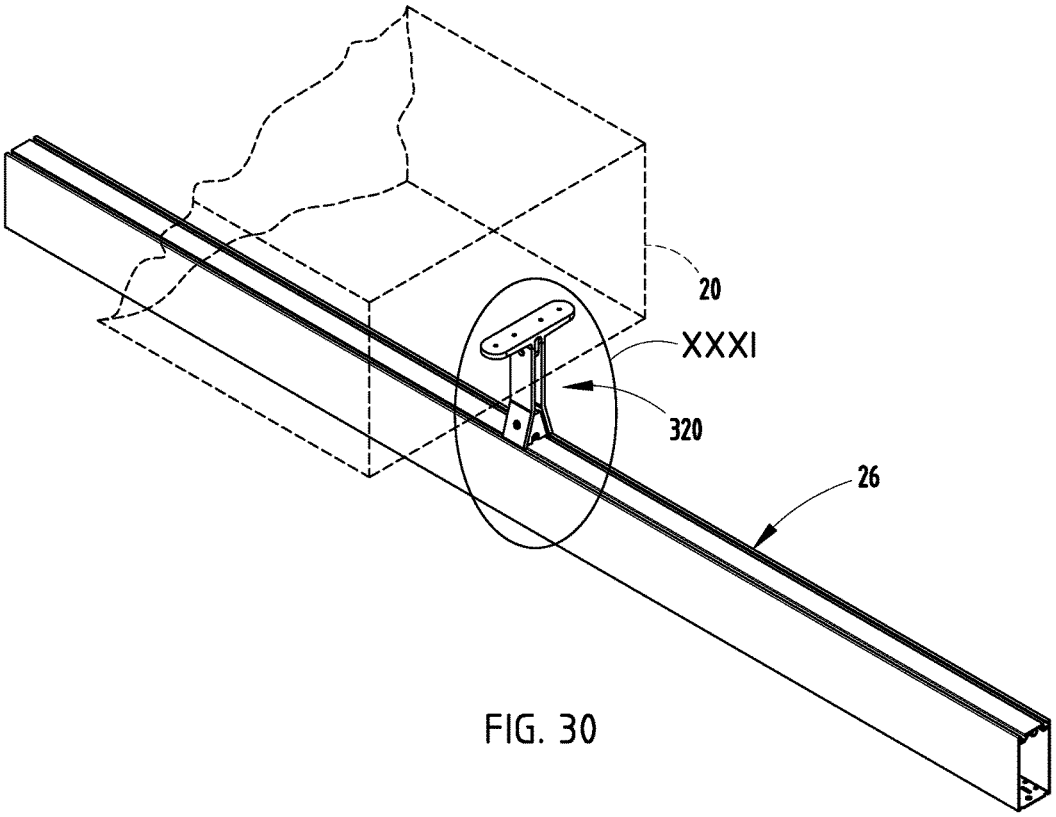
FIG. 30 is a perspective view of a storage unit supported above the beam by a stanchion assembly, wherein the storage unit is drawn in phantom.
Figure 31:
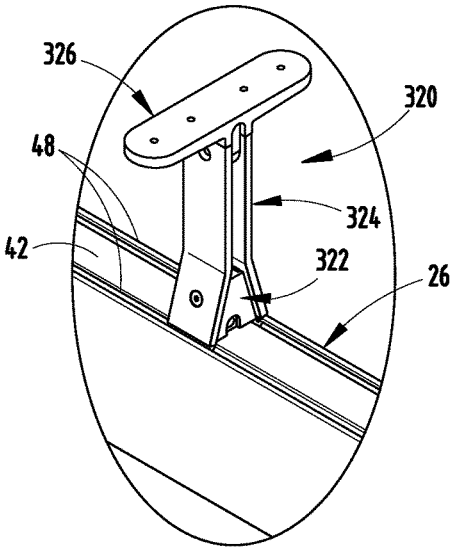
FIG. 31 is an enlarged view of area XXXI, FIG. 30, illustrating the beam and the stanchion assembly.

One of the work tools that is supported from the partition assembly 12 includes the elevated storage unit 20 (FIGS. 3 and 30) supported above an associated beam assembly 24 by a stanchion assembly 320 that engages the channels 48 of the beam member 26. Each stanchion assembly 320 (FIGS. 31-33) includes a clamping assembly 322 supporting a pedestal assembly 324 and a platform 326 thereabove. The clamping assembly 322 includes a pair of cooperating clamping blocks 328 each having a wedge surface 329 that abuts the wedge surface 329 of the cooperating block 328 and forces each of the blocks 328 in an outward direction B when adjusted towards one another by an adjustment bolt 330 received within apertures 331 extending through each of the blocks 328. In the illustrated example, at least one of the apertures 331 of the blocks 328 is non-concentric or sized thereby allowing movement of the blocks 328 in the direction B relative to one another. As each of the blocks 328 is forced in the outward direction B, a pair of engagement hooks 332 extending downwardly from the respective blocks 328 are forced into engagement with the outer walls 54 and bottom walls 58 of the channels 48. Specifically, a sidewall 333 of each of the engagement hooks 332 abuts a sidewall 54 of a respective channel 48, while an angled bottom wall 335 of each engagement hook 332 abuts the angled bottom wall 58. It is noted that each engagement hook 332 engages the respective channel 48 within the receiving portion 52 thereof, and that each engagement hook 32 does not fill the entire neck portion 50 of the channel 48, thereby allowing other work tools or work tool supporting assemblies to be co-located along the length of the beam member 26 with the stanchion assemblies 320, as described below.

Figure 32A:
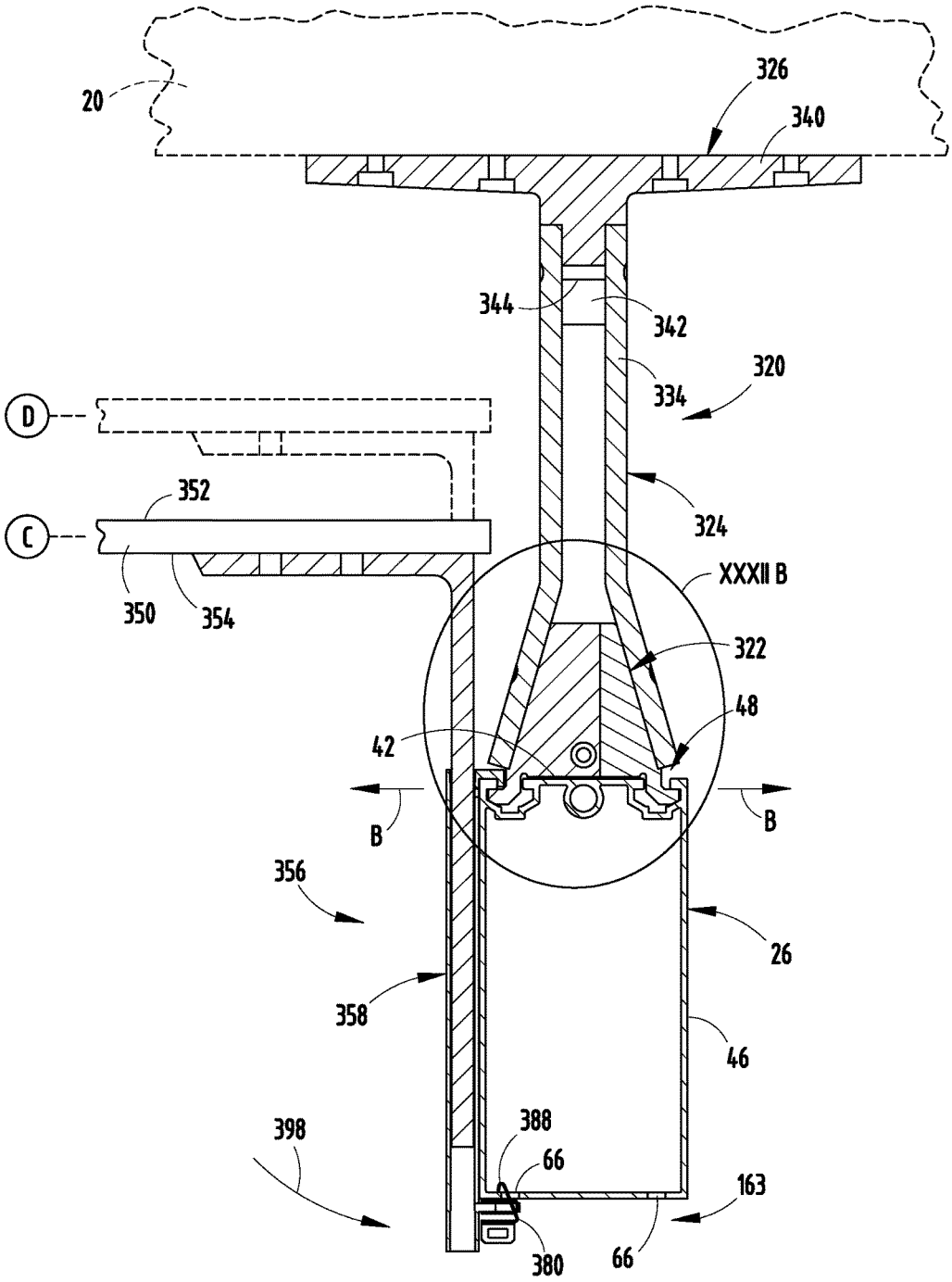
FIG. 32A is an end view of the beam member supporting the stanchion assembly and a worksurface support assembly therefrom, with a supported worksurface shown at two adjustable heights.
Figure 32B:
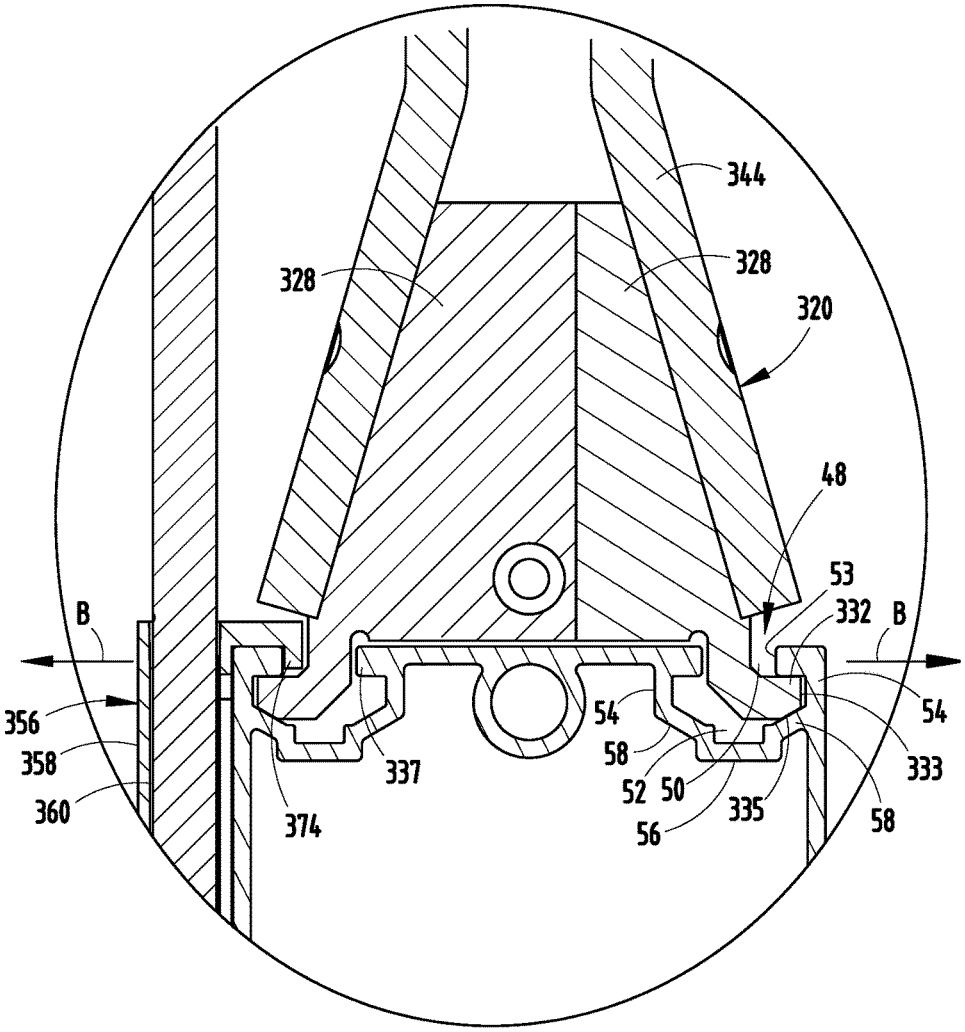
FIG. 32B is an enlarged end view of area XXXIIB, FIG. 32A.
Figure 33:
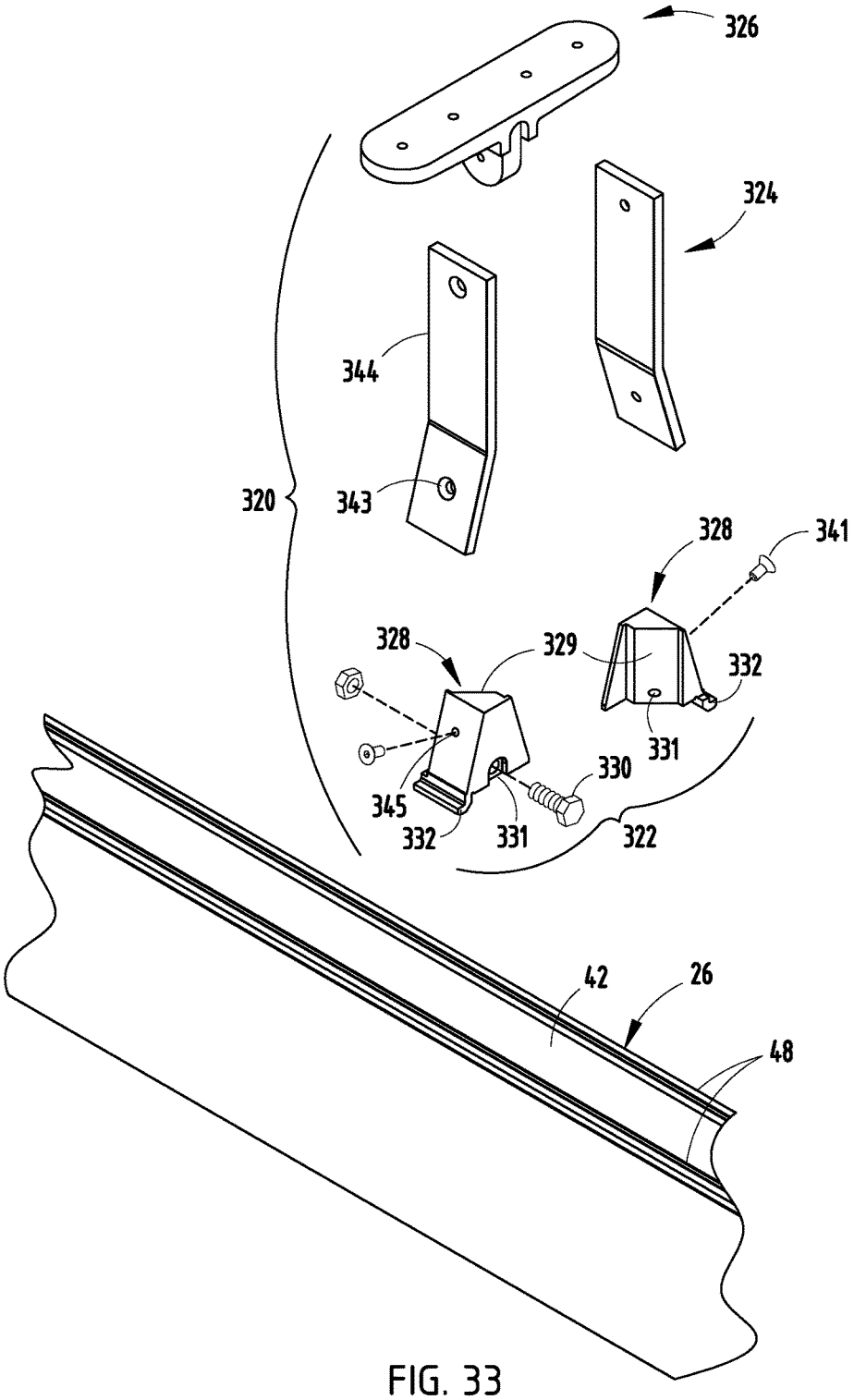
FIG. 33 is an exploded view of the beam member and the stanchion assembly, with a first embodiment of the clamping assembly.
Figure 34:
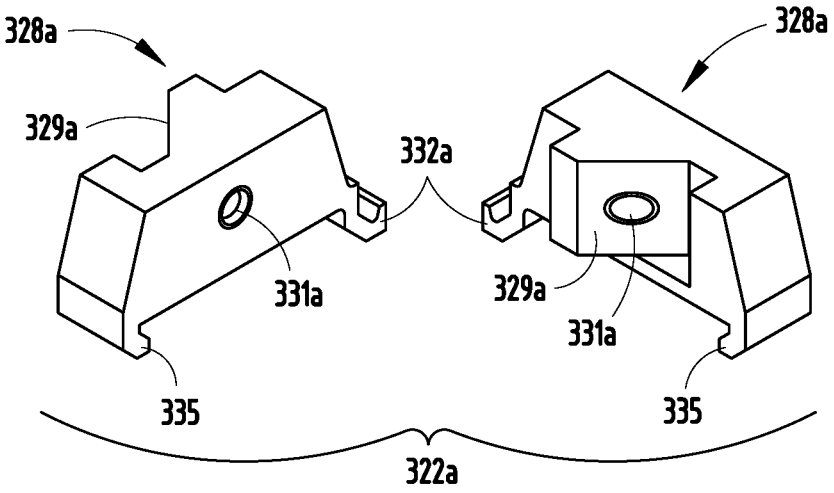
FIG. 34 is a perspective view of an alternative clamping assembly.
Figure 35:
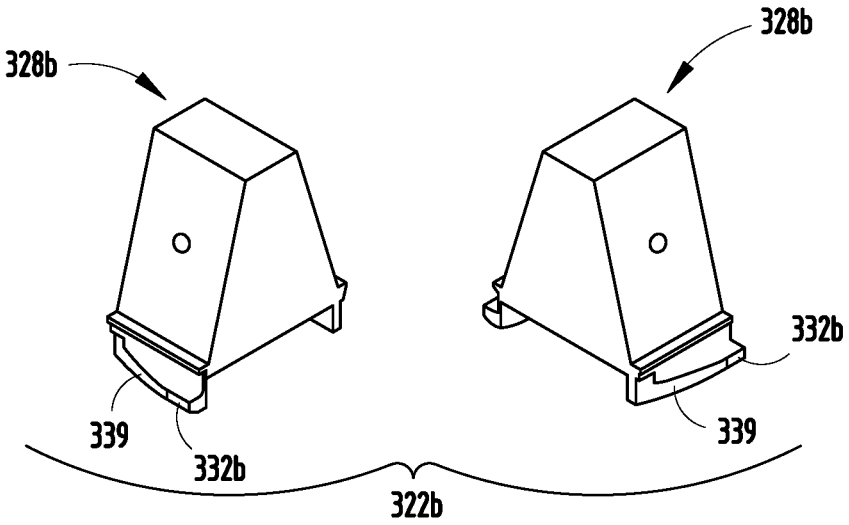
FIG. 35 is a perspective view of an alternative clamping block.

An alternative embodiment of the clamping assembly 322*a* is illustrated in FIG. 34, wherein each of the alternative clamping blocks 328*a* includes a cooperating wedge surface 329*a*, a bolt-receiving aperture 331*a*, and an upwardly and outwardly disposed engagement hook 332*a*, and an inwardly-extending inner engagement hook 335 juxtaposed across the block 328*a* from the engagement hook 322*a*. Each of the inner engagement hooks is adapted to engage an inner portion 337 (FIG. 32B) of the respective channel 48 when the clamping assembly 322*a* is secured to the beam member 26. Another alternative embodiment clamping assembly 322*b* is illustrated in FIG. 32, wherein the multiple clamping blocks 328 of the first embodiment are replaced with a single clamping block 328*b* that includes a pair of camming engagement hooks 332*b* juxtaposed across the block 328*b* from one another, wherein each of the engagement hooks 332*b* includes a relief 339 extending along a length thereof, thereby allowing the block 328*b* to be twist fit into engagement with the channel 48. The block 328*b* is then held in engagement with the channel 48 by assembly with the remaining components of the stanchion assembly 320 and the supported work tool, such as the storage unit 20.

In the illustrated example, the pedestal assembly 324 includes a pair of angled legs 334 attached to respective blocks 328 by screws 341 received within apertures 343 of the legs 334 and apertures 345 of the clamping blocks 328. Alternatively, the pedestal assembly 324 may be constructed of a single piece, which may have a hollow interior that receives the clamping blocks 328, 328*a*, 328*b* therein. The platform 326 is substantially T-shaped including a pair of supporting arms 340 extending orthogonally outward from a body portion 342 that is held between the legs 334 by a bolt 344.

Figure 36:
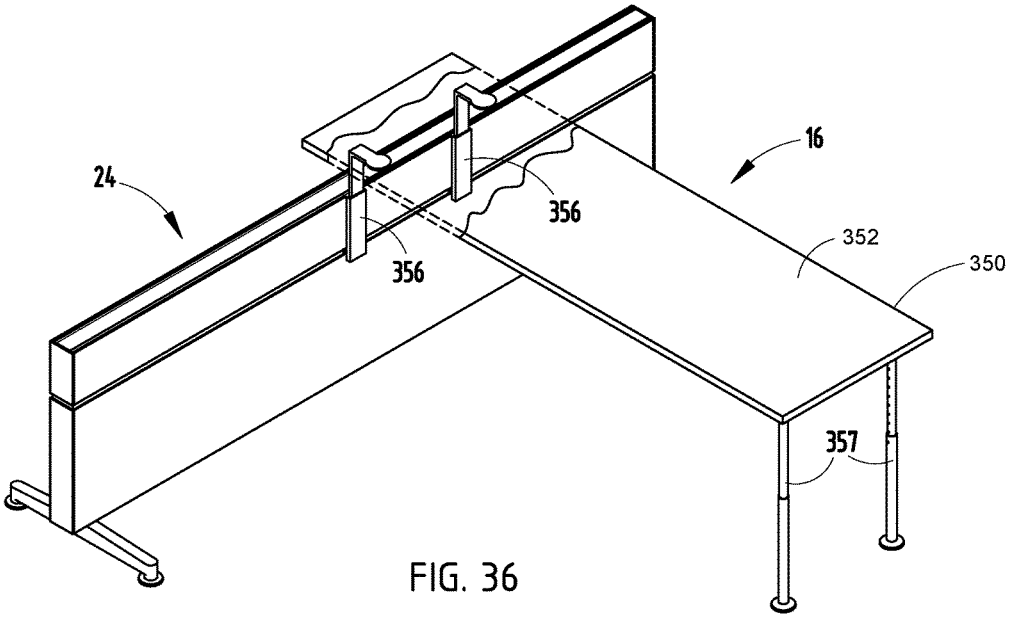
FIG. 36 is a perspective view of a beam assembly supporting a table assembly via the worksurface support assembly.
Figure 37:
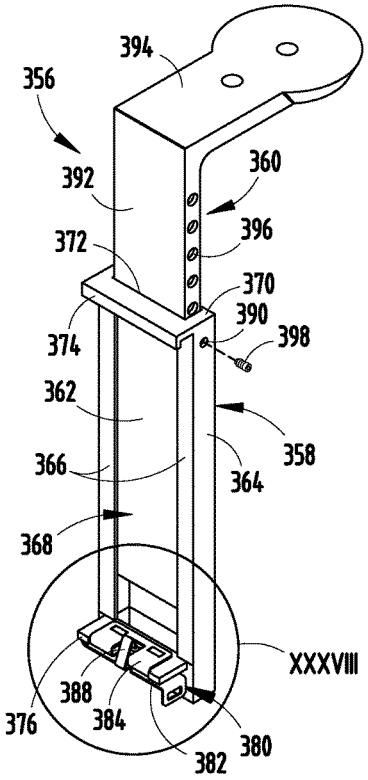
FIG. 37 is a perspective view of the worksurface support assembly.
Figure 38A:
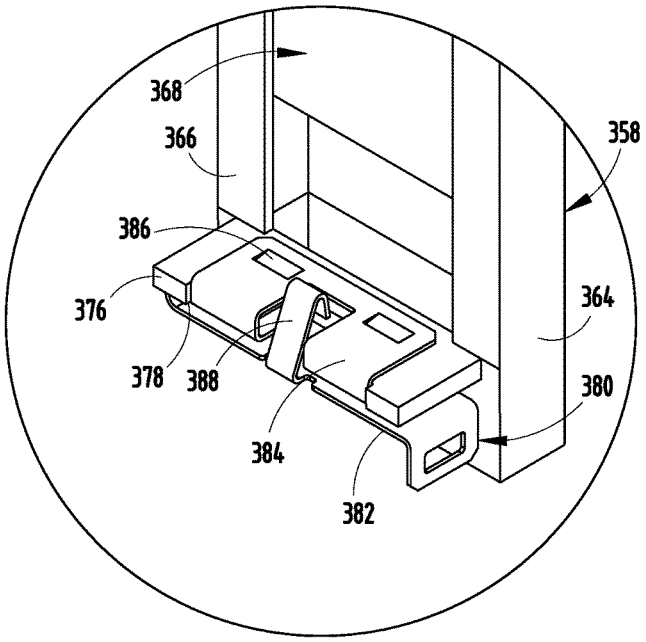
FIG. 38A is an enlarged perspective view of area XXXVIII, FIG. 37.
Figure 38B:
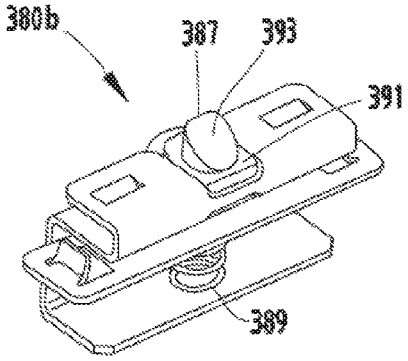
FIG. 38B is a perspective view of an alternative embodiment of a lower connector clip.

Another example of the work tools that are supported from the beam assembly 24 (FIG. 3) includes the table 16 that includes a worksurface 350 (FIG. 36) having an upper surface 352 and a lower surface 354, and that is supported between a plurality of vertical heights with respect to the beam member 26 by a worksurface support assembly 356 and leg assemblies 357. The worksurface support assembly 356 (FIG. 37) includes a guide member 358 and a support member 360 telescopingly received within the guide member 358. The guide member 358 has a box-like structure including an outer wall 362, a pair of sidewalls 364 extending orthogonally inward from the outer walls 362, and a pair of inner walls 366 extending orthogonally from the sidewalls 364, wherein the outer wall 362, the sidewalls 364 and the inner walls 366 cooperate to form a channel 368 that telescopingly receives the support member 360 therein. The guide member 358 further includes a top wall 370 having an aperture 372 that receives the support member 360 therethrough, and a rearwardly-extending, downwardly-opening hook portion 374 extending laterally across the width of the guide member 358. The guide member 358 further includes a rearwardly-extending mounting tab 376 located proximate a lower end of the guide member 358, and including a notch 378 extending across the width thereof. The notch 378 (FIG. 38A) receives a mounting clip 380 therein that includes a body portion 382, a clamping portion 384 having a pair of impingement tabs 386 that impinge upon the mounting tab 376, and an upwardly-extending, flexibly resilient spring pawl 388. Alternatively, the mounting clip 380*a* (FIG. 38B) includes a separate engagement pin 387 in place of the pawl 388, and a coil spring 389 to bias the pin 387 in an upward direction, and a plastic bushing 391 guiding the pin 387. The pin 387 has an angled top surface 393 to facilitate engagement during assembly. One of the sidewalls 364 of the guide member 358 includes a threaded aperture 390 located proximate an upper end of the guide member 358 and that receives a set screw 398 therein. The support member 360 is L-shaped and includes a body portion 392 that is telescopingly received within the channel 368 of the guide member 358 and an upper portion 394 that extends orthogonally to the body portion 392 and is adapted to be secured to the worksurface 350. The body portion 392 includes a plurality of reliefs 396 spaced along the length thereof. Alternatively, the support member 360 may be T-shaped (not shown) and support a worksurface that extends across the beam assembly 24 providing work areas on both sides of the beam assembly 24.

In assembly, the worksurface support assembly 356 is attached to the beam member 26 by inserting the hook portion 374 of the guide member 358 into engagement with one of the channels 48 of the beam member 26 and then swinging a lower end of the worksurface support assembly 356 in a direction 398 until the mounting clip 380 and the mounting tab 376 extend into the gap 163 between the beam member 26 and the cover member 32 and the spring pawl 388 is received within one of the apertures 66 of the beam member 26. It is noted that the hook portion 374 of the worksurface support assembly 356 engages only a portion of the neck portion 50 of the engaged channel 48, thereby allowing the worksurface support assembly 356 to be co-located along with the stanchion assembly 320 at the same position along the length of the beam member 26. In operation, the set screw 398 is received within the aperture 390 and engages a select one of the reliefs 396 within the support member 360, thereby allowing a user to selectively position the work surface 350 between a plurality of vertical positions, such as a first vertical position C and a second vertical position D. Preferably, the worksurface support assembly 356 is configured such that at least one of the vertical positions locates the upper surface 352 of the worksurface 350 above the top wall 42 of the beam member 26.

Figure 39:
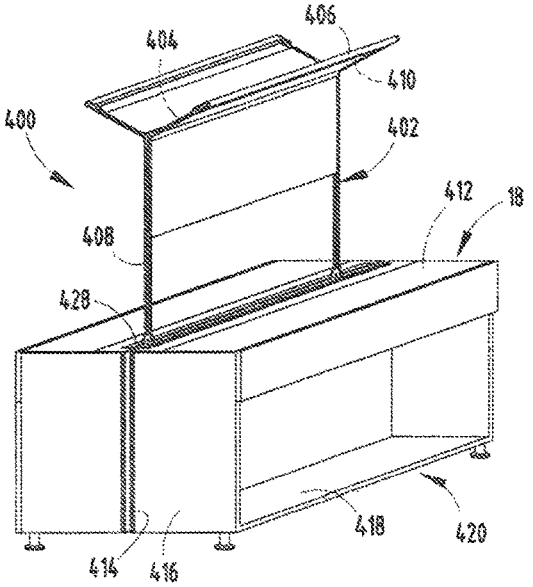
FIG. 39 is a perspective view of a plurality of tethered storage units supporting a privacy screen therefrom.
Figure 40:
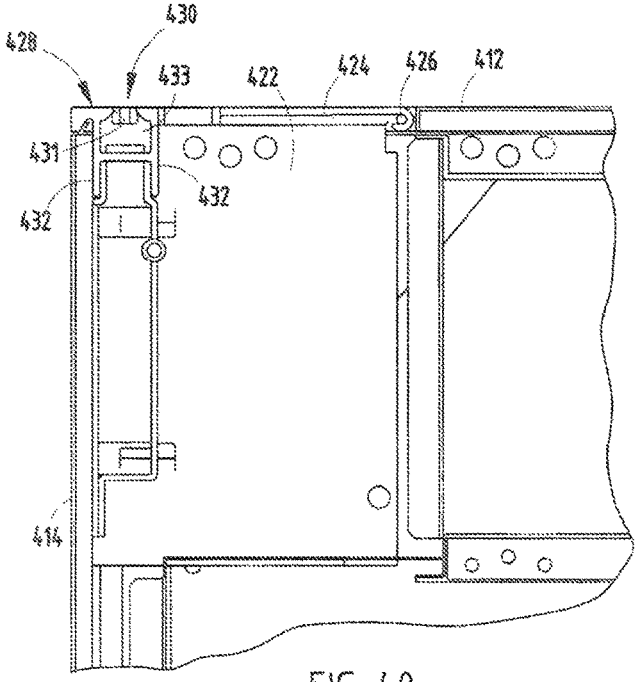
FIG. 40 is a partial end view of one of the storage units with an end wall thereof removed so as to display the internal components thereof.

Another work tool of the furniture system 12 includes an overhead screen assembly 400 (FIG. 39). The screen assembly 400 includes a frame assembly 402 having Y-shaped upper frame members 404, cross frame members 406 extending between distal ends of the upper frame members 404, and a stanchion assembly 408 similar in construction to the previously-described stanchion assembly 320. In the illustrated example, the screen assembly 400 includes a screen insert 410, however, other elements may be supported within and from the frame assembly 402, including, but not limited to, screen arrangements differing from that which is illustrated, shelving units, lighting fixtures, acoustical buffers, and the like. In the illustrated example, the screen assembly 400 is supported above and by a pair of the lower storage units 18 each including a top wall 412, a rear wall 414, a pair of sidewalls 416, and a bottom wall 418 that cooperate with one another to form an interior area 420. Although the illustrated lower storage unit 18 includes an open front, other arrangements including drawers and doors may also be utilized. The lower storage unit 18 also includes a laterally-extending power zone or area 422 (FIG. 40) extending laterally across a rear portion of the storage unit 18, and that is adapted to receive electrical/communication lines, power distribution blocks, power receptacle, and the like therein. An access door 424 pivotally coupled at a point 426 provides access to the power zone 422. The storage unit further includes a laterally-extending rail member 428 located rearward of the power zone 422 and having outer walls 432 and an upwardly-opening, inverted T-shaped channel 430 extending therealong and having a neck portion 431 and a receiving portion 433. It is noted that the shape of the channel 430 is similar to the shape of each of the channels 48 within the beam member 24, thereby allowing the coupling of work tools and work tool support assemblies with both the beam member 26 and the rail member 428.

Figure 41:
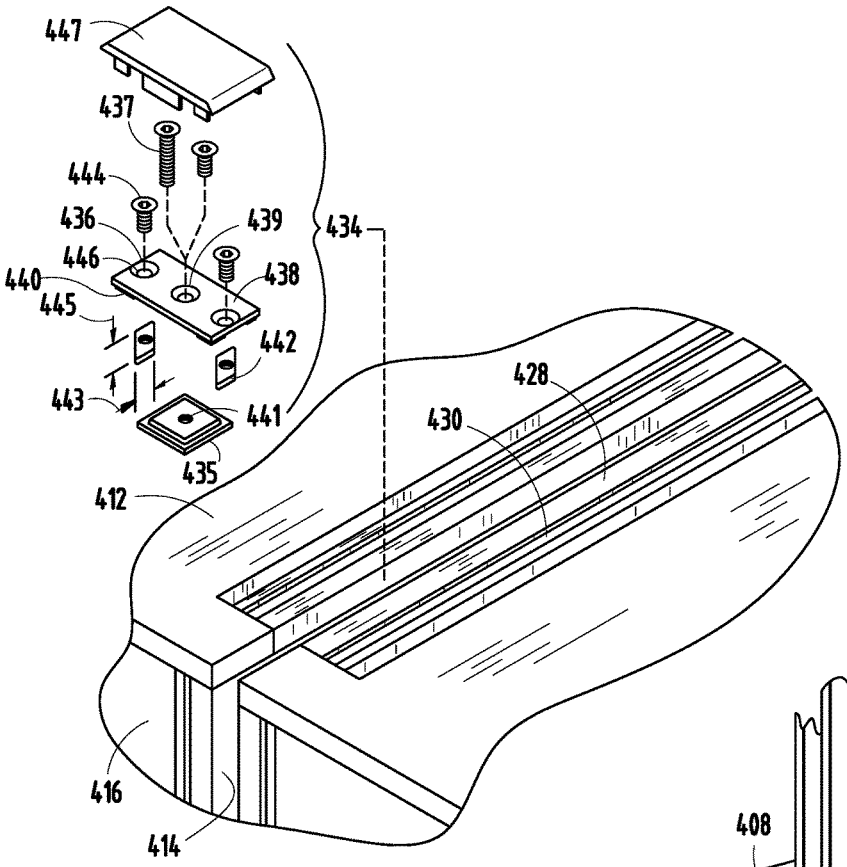
FIG. 41 is an exploded perspective view of a clamping assembly.
Figure 42:
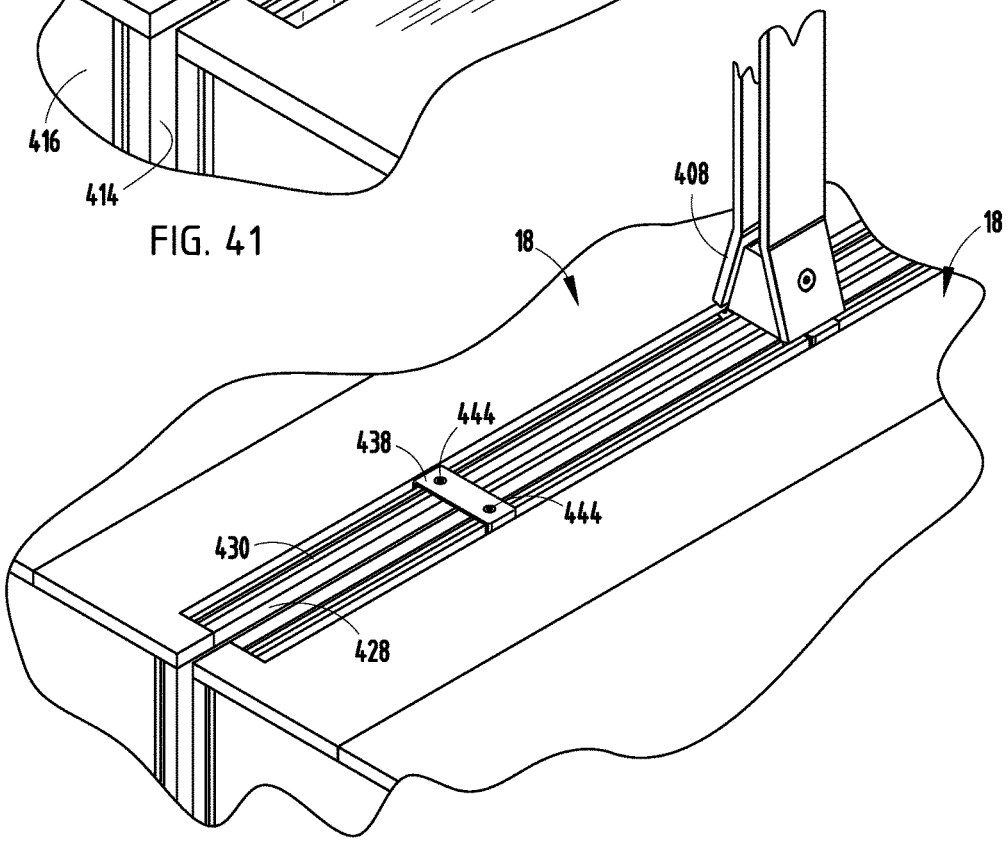
FIG. 42 is a perspective view of the worksurfaces coupled together via the clamping assembly, and a stanchion being supported by rails of each of the storage units.
Figure 43:
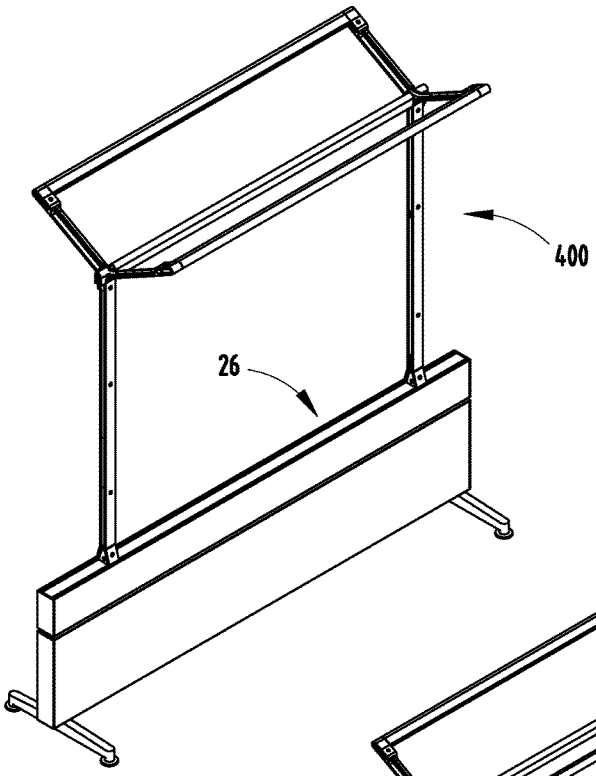
FIG. 43 is a perspective view of the privacy screen supported above the beam assembly.
Figure 44:
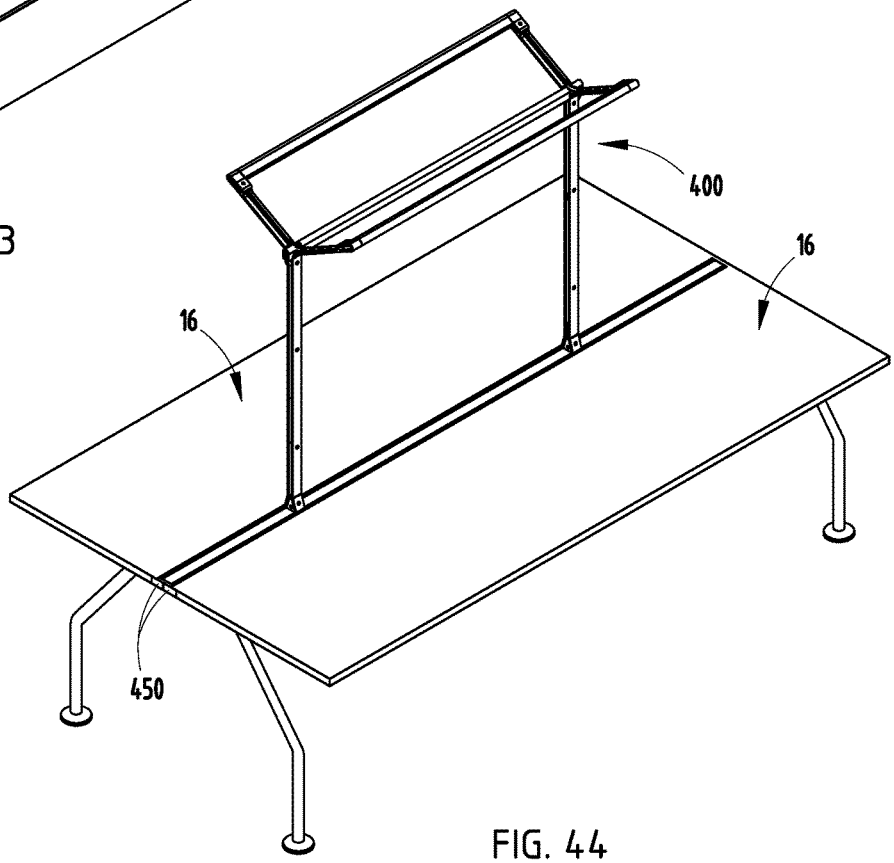
FIG. 44 is a perspective view of a plurality of tables cooperating to support the privacy screen thereabove.

As best illustrated in FIGS. 39, 41 and 42, a pair of the storage units 18 is tethered together in a back-to-back relationship by a tether bracket assembly 434. The tether bracket assembly 434 includes a tether bracket 436 having a body portion 438 and a pair of downwardly-extending arms 440. The tether bracket assembly 434 further includes a spacer 435, and a pair of parallelogram-shaped nuts 442 and associated bolts 444. Each nut 442 has a first width 443 that is less than the width of the neck portion 431 of the channel 430, and a second width 445 that is greater than the width of the neck portion 431. In assembly, the spacer 475 is positioned between the rail member 428, and is secured to the tether bracket 436 by a bolt 437 extending through an aperture 439 and threadably received into an aperture 441 of the space 435, bolts 444 are positioned within corresponding apertures 446 of the body portion 438 and are threadably received within the nuts 442. The tether bracket assembly 434 is then positioned with respect to the pair of storage units 18 such that the arms 440 abut the outer walls 432 of the rail members 428, while the first width 443 of the nuts 442 are aligned with the channels 430. Once the nuts 442 are inserted into the receiving portion 443, tightening of the bolts 432 turns the nuts 442 into engagement with the channels 430, thereby coupling the storage units to one another and creating a combined twin-channel system. Specifically, the channels 430 of the tethered storage units 18 are spaced a substantially similar distance apart as the channel members 48 within the beam member 24, thereby allowing work tools such as the screen assembly 400 to be alternatively supported either above the beam assembly 26 (FIG. 43), or above pairings of furniture components, such as the storage units 18. A snap-fit cover member 447 may provide an aesthetic aperture to the tether bracket assembly 434. Likewise, other free-standing furniture components may also be utilized in cooperation with one another to form a twin-channel support structure, such as the tables 16 illustrated in FIG. 44. In the illustrated example, the tables 16 each include a rail member 450 extending along a rear edge thereof and including a channel similar in cross-sectional configuration to the channel 430 of the storage unit 18. The rail members 450 of the respective tables 16 are coupled to one another via a tether bracket assembly similar to the tether bracket assembly 434, thereby creating the twin-slot support system.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition assembly for subdividing a floor plan area, comprising:

a beam assembly, comprising:

a horizontally extending beam member including an upper wall, a pair of side walls extending downwardly from the upper wall, a bottom wall extending between the pair of sidewalls, a first end, a second end, and a pair of upwardly opening channels located in the upper wall and extending between the first end and the second end, wherein each of the channels of the pair of channels is positioned closer to one of the pair of side walls than to a longitudinally-extending center line of the beam member;

at least one horizontally extending lower frame member located below the beam member; and a plurality of vertical frame members extending between the beam member and the at least one lower frame member;

a work tool positioned above the beam assembly, wherein the work tool includes at least one of a storage unit, a privacy screen, a shelving unit, a lighting fixture, and an acoustical buffer; and a connector assembly connecting the work tool to the beam assembly, where the connector assembly is coupled to the work tool and simultaneously engages both of the channels of the pair of channels of the beam member.

2. The partition assembly of claim 1, wherein each of the channels has a substantially T-shaped cross-sectional configuration.

3. The partition system of claim 1, wherein each of the channels includes a downwardly extending neck portion having a first width, and a receiver portion located below the neck portion and in uninterrupted communication with the neck portion, the receiver portion having a second width that is greater than the first width.

4. The partition system of claim 1, wherein the bottom wall of the beam member includes a plurality of apertures spaced along the length thereof.

5. The partition system of claim 1, wherein the connector assembly engages the beam member by the pair of channels only.

6. The partition assembly of claim 1, wherein the beam assembly is one of a pair of beam assemblies, and wherein the pair of beam assemblies are coupled in an end-to-end relationship such that the pair of channels of the beam members are uninterrupted between the pair of beam assemblies allowing the work tool to be repositioned between the pair of beam assemblies while the work tool remains supported from the channels.

7. The partition assembly of claim 1, wherein the beam member of the beam assembly is a single, integral piece.

8. The partition assembly of claim 1, wherein the work tool includes the storage unit.

9. The partition assembly of claim 1, wherein the at least one horizontally extending lower frame member includes a pair of horizontally extending lower frame members, and wherein at least one of the plurality of vertical frame members includes a first width and a second width that is less than the first width and that is positioned directly between the pair of lower frame members.

10. The beam assembly of claim 9, wherein the plurality of vertical frame members are coupled to the lower frame members via a mechanical fastener.

11. The partition assembly of claim 1, wherein at least one of the plurality of vertical frame members abuts a downwardly-facing surface of the beam member.

12. The beam assembly of claim 11, wherein the upper wall of the beam member includes the downwardly-facing surface abutted by the at least one of the vertical frame members.

13. The partition assembly of claim 1, wherein each of the channels of the pair of channels is an outermost channel in a lateral direction transverse to the longitudinally extending centerline of the beam member.

14. A partition assembly for subdividing a floor plan area, comprising:

a beam assembly, comprising:

a horizontally extending beam member including an upper wall, a pair of side walls extending downwardly from the upper wall, a bottom wall extending between the pair of sidewalls, a first end, a second end, and a pair of upwardly opening channels located in the upper wall and extending in a longitudinal direction between the first end and the second end, wherein each of the channels of the pair of channels is an outermost channel in a lateral direction transverse to the longitudinal direction;

at least one horizontally extending lower frame member located below the beam member; and a plurality of vertical frame members extending between the beam member and the at least one lower frame member;

a work tool positioned above the beam assembly, wherein the work tool includes at least one of a storage unit, a privacy screen, a shelving unit, a lighting fixture, and an acoustical buffer; and a connector assembly connecting the work tool to the beam assembly, where the connector assembly is coupled to the work tool and simultaneously engages both of the channels of the pair of channels of the beam member.

15. The partition assembly of claim 14, wherein each of the channels has a substantially T-shaped cross-sectional configuration.

16. The partition system of claim 14, wherein each of the channels includes a downwardly extending neck portion having a first width, and a receiver portion located below the neck portion and in uninterrupted communication with the neck portion, the receiver portion having a second width that is greater than the first width.

17. The partition system of claim 14, wherein the bottom wall of the beam member includes a plurality of apertures spaced along the length thereof.

18. The partition system of claim 14, wherein the connector assembly engages the beam member by the pair of channels only.

19. The partition assembly of claim 14, wherein the beam assembly is one of a pair of beam assemblies, and wherein the pair of beam assemblies are coupled in an end-to-end relationship such that the pair of channels of the beam members are uninterrupted between the pair of beam assemblies allowing the work tool to be repositioned between the pair of beam assemblies while the work tool remains supported from the channels.

20. The partition assembly of claim 14, wherein the beam member of the beam assembly is a single, integral piece.

21. The partition assembly of claim 14, wherein the work tool includes the storage unit.

22. The partition assembly of claim 14, wherein the each channel of the pair of channels is positioned closer to one of the pair of side walls than to a longitudinally extending center line of the beam member.

23. The partition assembly of claim 14, wherein the at least one horizontally extending lower frame member includes a pair of horizontally extending lower frame members, and wherein at least one of the plurality of vertical frame members includes a first width and a second width that is less than the first width and that is positioned directly between the pair of lower frame members.

24. The beam assembly of claim 23, wherein at plurality of vertical frame members are coupled to the lower frame members via a mechanical fastener.

25. The partition system of claim 14, wherein the connected assembly engages the beam member by the pair of channels only.

26. The partition assembly of claim 14, wherein at least one of the plurality of vertical frame members abuts a downwardly-facing surface of the beam member.

27. The beam assembly of claim 26, wherein the upper wall of the beam member includes the downwardly-facing surface abutted by the at least one of the vertical frame members.

* * * * *